US009680252B2

(12) United States Patent
Hashiguchi

(10) Patent No.: US 9,680,252 B2
(45) Date of Patent: Jun. 13, 2017

(54) CONNECTOR PAIR INCLUDING A CONNECTOR HAVING A FACE PORTION AND A MAGNETIC PORTION

(71) Applicant: JAPAN AVIATION ELECTRONICS INDUSTRY, LIMITED, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/873,534

(22) Filed: Oct. 2, 2015

(65) Prior Publication Data

US 2016/0181728 A1 Jun. 23, 2016

(30) Foreign Application Priority Data

Dec. 18, 2014 (JP) ..... 2014-256345

(51) Int. Cl.

| | |
|---|---|
| ***H01R 13/62*** | (2006.01) |
| ***H01R 24/00*** | (2011.01) |
| *H01R 103/00* | (2006.01) |
| *H01R 13/24* | (2006.01) |

(52) U.S. Cl.

CPC ..... *H01R 13/6205* (2013.01); *H01R 24/005* (2013.01); *H01R 13/2428* (2013.01); *H01R 2103/00* (2013.01)

(58) Field of Classification Search

CPC ..... H01R 13/6205
USPC ..... 439/38, 39, 40
See application file for complete search history.

(56) References Cited

U.S. PATENT DOCUMENTS

| | | | | |
|---|---|---|---|---|
| 3,521,216 | A | 7/1970 | Tolegian | |
| 5,895,282 | A | 4/1999 | Little | |
| 6,231,349 | B1 | 5/2001 | Bullinger et al. | |
| 6,821,126 | B2 | 11/2004 | Neidlein | |
| 6,966,781 | B1 | 11/2005 | Bullinger et al. | |
| 7,351,066 | B2 | 4/2008 | DiFonzo et al. | |
| 7,641,477 | B2 | 1/2010 | DiFonzo et al. | |
| 7,658,613 | B1 * | 2/2010 | Griffin | H01R 13/6205 439/39 |

(Continued)

FOREIGN PATENT DOCUMENTS

| | | |
|---|---|---|
| JP | H 10-92517 A | 4/1998 |
| JP | 2000-517097 A | 12/2000 |

(Continued)

*Primary Examiner* — Renee Luebke
*Assistant Examiner* — Paul Baillargeon
(74) *Attorney, Agent, or Firm* — Collard & Roe, P.C.

(57) ABSTRACT

A connector pair comprises a connector and a mating connector. A movement of the connector to a first position along a first direction and a subsequent movement of the connector from the first position to a second position along a second direction perpendicular to the first direction completes a connection between the connector and the mating connector. The connector comprises a magnetic portion, and the mating connector comprises a mating magnetic portion. When the connector is located at the first position, the magnetic portion receives a force, which urges the connector to be moved toward the second position, from the mating magnetic portion. When the connector is located at the second position, the magnetic portion receives a force, which binds the connector at the second position, from the mating magnetic portion.

9 Claims, 15 Drawing Sheets

(56) References Cited

U.S. PATENT DOCUMENTS

| | | | | |
|---|---|---|---|---|
| 8,174,347 | B2 * | 5/2012 | Fullerton | E05C 19/16<br>335/285 |
| 8,497,753 | B2 | 7/2013 | DiFonzo et al. | |
| 8,608,502 | B2 * | 12/2013 | Witter | H01R 13/6205<br>439/335 |
| 8,970,332 | B2 | 3/2015 | DiFonzo et al. | |

FOREIGN PATENT DOCUMENTS

| | | | |
|---|---|---|---|
| JP | 2004-047367 | A | 2/2004 |
| JP | 4004953 | B2 | 11/2007 |
| JP | 4774439 | B2 | 9/2011 |
| WO | 97/50152 | A1 | 12/1997 |

* cited by examiner

CONNECTOR PAIR INCLUDING A CONNECTOR HAVING A FACE PORTION AND A MAGNETIC PORTION

CROSS REFERENCE TO RELATED APPLICATIONS

An applicant claims priority under 35 U.S.C. §119 of Japanese Patent Application No. JP2014-256345 filed Dec. 18, 2014.

BACKGROUND OF THE INVENTION

This invention relates to a connector pair comprising a connector and a mating connector connectable with each other by using a magnetic force.

For example, this type of connector and mating connector is disclosed in JP-B 4004953 (Patent Document 1), the content of which is incorporated herein by reference.

Referring to FIGS. 27 and 28, Patent Document 1 discloses the connector (current tap housing) 900 connectable with the mating connector (current supply housing) 950. Referring to FIG. 27, the current tap housing 900 comprises flat contacts 902, magnets 904 and a pin-like projection 906. Referring to FIGS. 28 and 29, the current supply housing 950 comprises flat contacts 952, current supply terminals 954, a permanent magnet 956, a magnetic carriage 960 movable in an upper-lower direction in FIG. 29 and a rotating device 970. The magnetic carriage 960 is provided with magnets 962 having magnetic poles different from those of the magnets 904 (see FIG. 27) and current contact points 964 connected to the current supply terminals 954, respectively. The rotating device 970 is provided with a cutout 974 extending from an entry/exit region 972.

Referring to FIG. 29, a magnetic force (Fd) causes the magnets 962 to be constantly attracted toward the permanent magnet 956. As a result, the magnetic carriage 960 is located at a lower part of the current supply housing 950 unless another magnetic force larger than the magnetic force (Fd) causes the magnets 962 to be attracted upward. Referring to FIGS. 27 to 29, when the pin-like projection 906 of the current tap housing 900 is inserted into the entry/exit region 972 of the current supply housing 950, the flat contacts 902 are connected to the flat contacts 952, respectively. At that time, the magnets 904 overlap the magnets 962 to some extent and therefore receive a turning force from the magnets 962, wherein the turning force causes the current tap housing 900 to be turned. When the pin-like projection 906 of the thus-turned current tap housing 900 is moved through the cutout 974 and arrives at a current contact region 974C, the magnets 904 further overlap the magnets 962 so that a magnetic force larger than the magnetic force (Fd) causes the magnets 962 to be attracted toward the magnets 904, and the magnetic carriage 960 is moved upward. The flat contacts 902 are therefore connected with the current supply terminals 954, respectively, via the flat contacts 952 and the current contact points 964.

In Patent Document 1, the current tap housing 900 includes the four magnets 904, and the magnetic carriage 960 includes the four magnets 962 corresponding to the magnets 904, respectively. These magnets 904 and magnets 962 are arranged in a skilled manner so as to apply the turning force to the current tap housing 900 as well as to move the magnetic carriage 960 upward at an appropriate timing. In other words, a structure including a precise arrangement of many magnets enables the current tap housing 900 to be connected with the current supply housing 950.

SUMMARY OF THE INVENTION

It is an object of the present invention to provide a new structure in order to connect a connector with a mating connector by using a magnetic force. More specifically, the object of the present invention is to provide a connector pair comprising a connector and a mating connector connectable with each other by using a magnetic force, wherein the connector pair has a structure including a simple arrangement of a small number of magnets.

One aspect of the present invention provides a connector pair comprising a connector and a mating connector. A movement of the connector to a first position along a first direction causes the connector to be mated with the mating connector. Another movement of the connector from the first position to a second position along a second direction perpendicular to the first direction completes a connection between the connector and the mating connector. The connector comprises a face portion and a magnetic portion. The face portion holds the magnetic portion which includes a north pole portion and a south pole portion arranged in the second direction. The mating connector comprises a mating face portion and a mating magnetic portion. The mating face portion holds the mating magnetic portion which includes a mating north pole portion and a mating south pole portion arranged in the second direction. The face portion and the mating face portion face each other in the first direction not only when the connector is located at the first position but also when the connector is located at the second position. When the connector is located at the first position, the magnetic portion receives a force, which urges the connector to be moved toward the second position, from the mating magnetic portion. When the connector is located at the second position, the magnetic portion receives a force, which binds the connector at the second position, from the mating magnetic portion.

According to the present invention, the north pole portion and the south pole portion of the connector are arranged in the second direction, and the mating north pole portion and the mating south pole portion of the mating connector are also arranged in the second direction. Such arrangement of the north pole portion and the south pole portion can be easily made, for example, with use of a single permanent bar magnet. Similarly, such arrangement of the mating north pole portion and the mating south pole can be easily made with use of another single permanent bar magnet. The simple structure of the thus-arranged small number of magnets exerts a magnet force to connect the connector with the mating connector.

An appreciation of the objectives of the present invention and a more complete understanding of its structure may be had by studying the following description of the preferred embodiment and by referring to the accompanying drawings.

Figure 1:
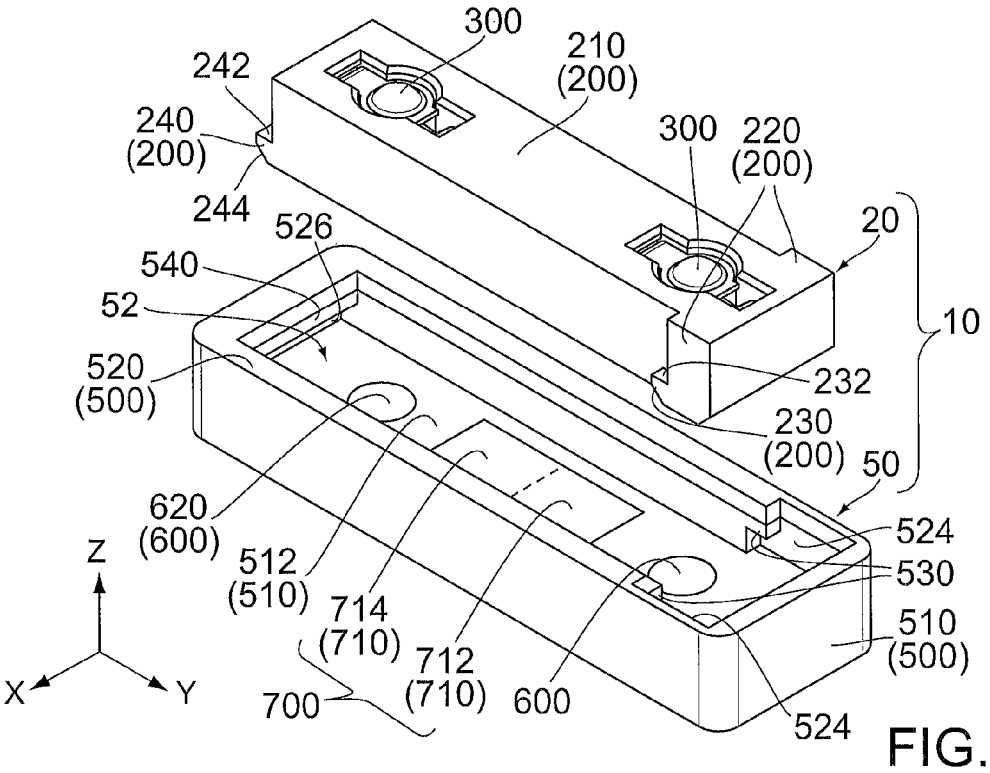
FIG. 1 is a perspective view showing a connector pair according to a first embodiment of the present invention, wherein a connector and a mating connector of the connector pair are in an unmated state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 5:
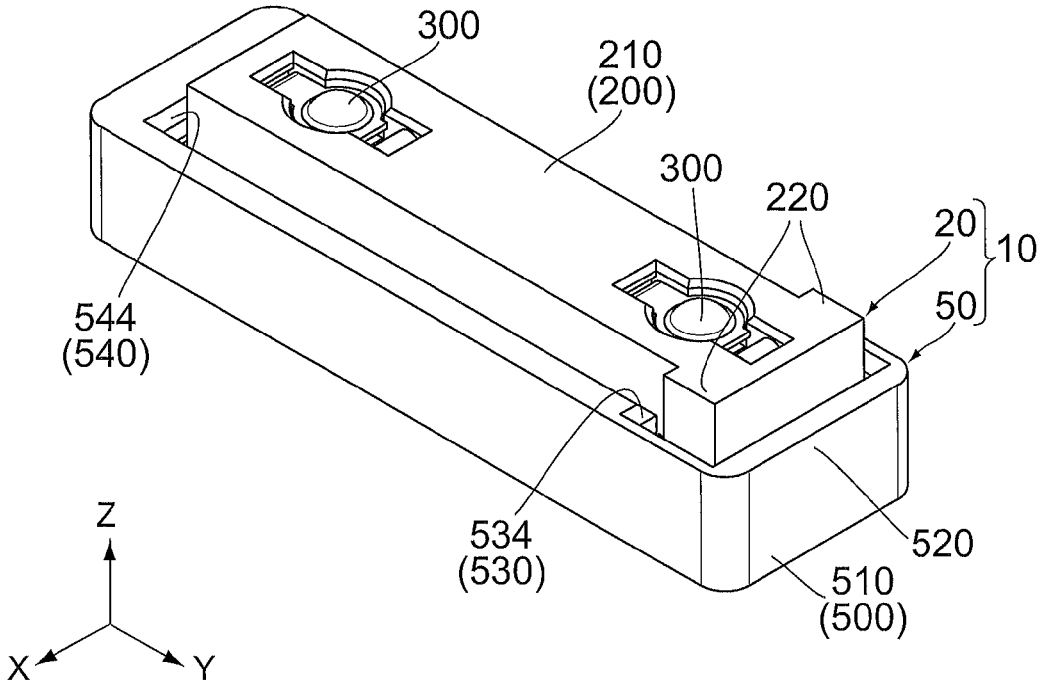
FIG. 5 is a perspective view showing the connector pair of FIG. 1, wherein the connector is located at a first position.
Figure 7:
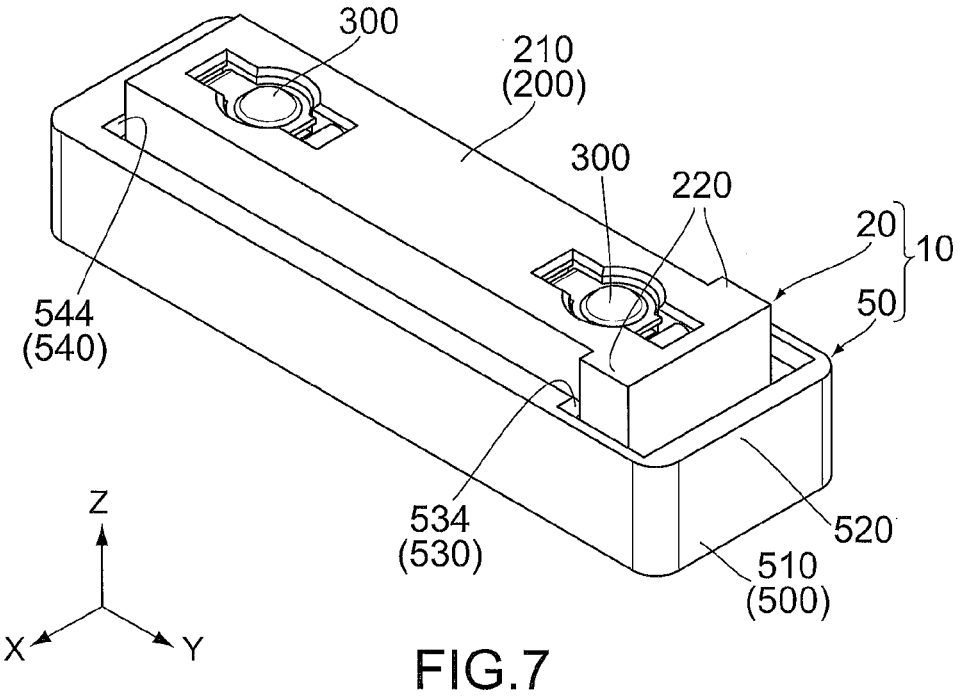
FIG. 7 is a perspective view showing the connector pair of FIG. 1, wherein the connector is located at a second position.

As shown in FIG. 1, a connector pair 10 according to a first embodiment of the present invention comprises a connector 20 and a mating connector 50. Referring to FIGS. 1, 5 and 7, the connector 20 is mateable and connectable with the mating connector 50. In detail, prior to the mating of the connector 20 with the mating connector 50, the connector 20 is placed at an unmated position (the position shown in FIG. 1) which is located just above, or toward the positive Z-side of, the mating connector 50 in an upper-lower direction (Z-direction: first direction). Then, a downward movement, or a movement in the negative Z-direction, of the connector 20 from the unmated position to a first position (the position shown in FIG. 5) along the Z-direction causes the connector 20 to be mated with the mating connector 50. Subsequently, a forward movement, or a movement in the negative Y-direction, of the connector 20 from the first position to a second position (the position shown in FIG. 7) along a front-rear direction (Y-direction: second direction) completes a connection between the connector 20 and the mating connector 50.

Figure 2:
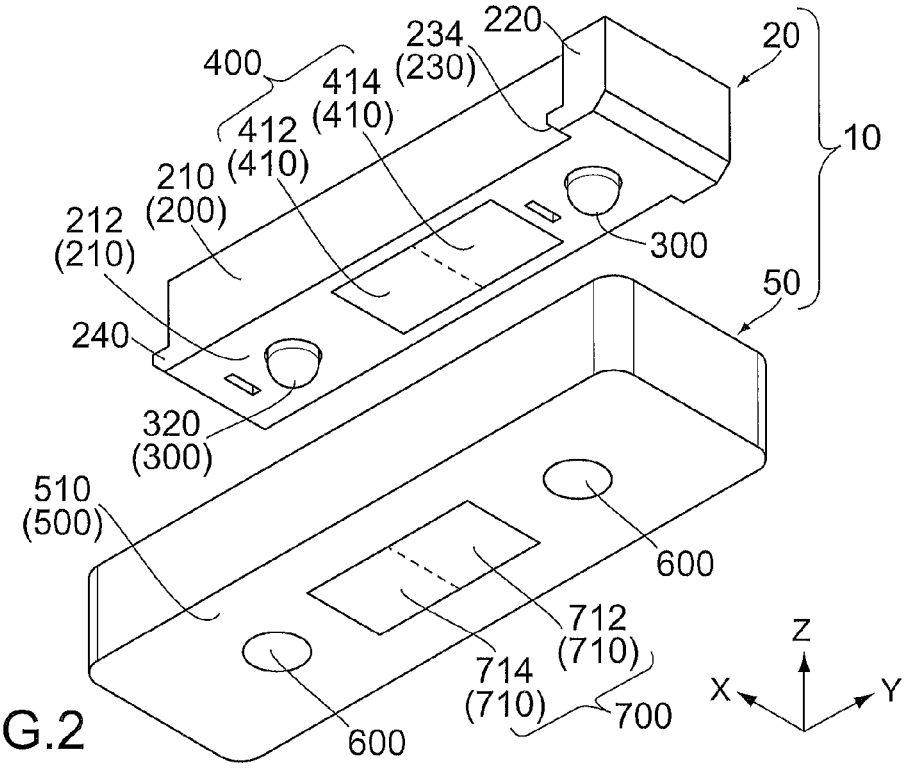
FIG. 2 is another perspective view showing the connector pair of FIG. 1.
Figure 4:
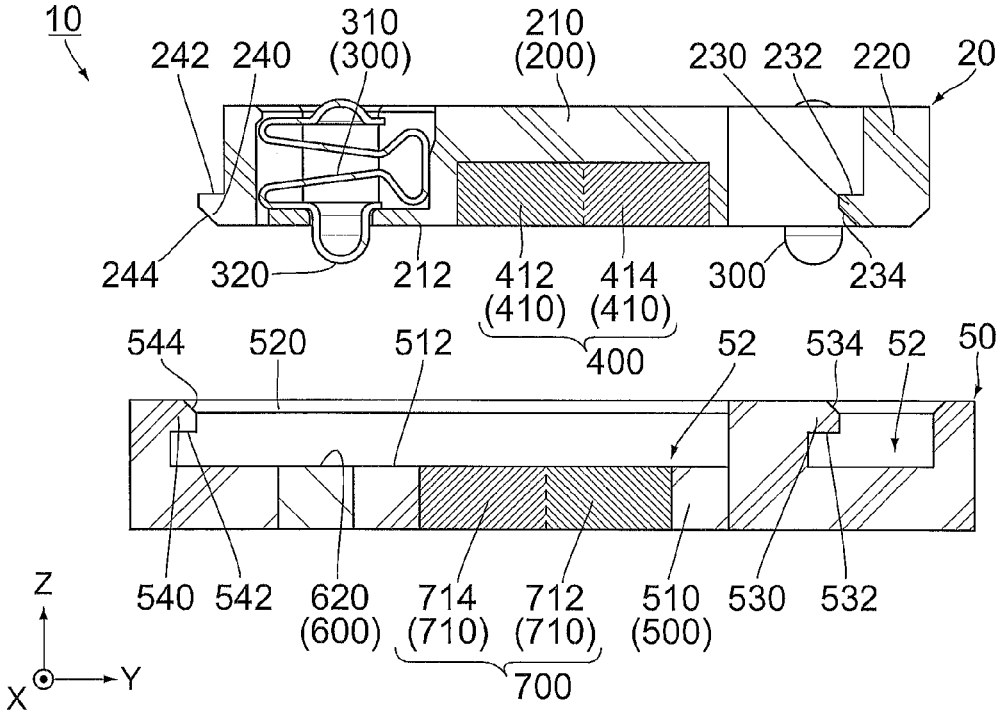
FIG. 4 is a cross-sectional view showing the connector pair of FIG. 3, taken along line IV-IV.

Referring to FIGS. 2 and 4, the connector 20 according to the present embodiment comprises a housing 200 made of insulator, two contacts 300 each made of conductor and a single magnet 410.

As shown in FIGS. 1 to 4, the housing 200 has a holding portion 210, two side portions 220, two locked portions 230 and one locked portion 240. The holding portion 210 has a cuboid shape which is long in the Y-direction. The side portions 220 are located at a rear end, or the positive Y-side end, of the holding portion 210 while protruding outward in a lateral direction (X-direction) from opposite sides of the holding portion 210 in the X-direction, respectively. The locked portions 230 are located at lower ends, or the negative Z-side ends, of the side portions 220, respectively, while projecting forward from the side portions 220. The locked portion 240 is located at a lower end of a front surface, or the negative Y-side surface, of the holding portion 210, while projecting forward from the holding portion 210.

Referring to FIGS. 2 and 4, the holding portion 210 has a face portion 212. In other words, the connector 20 comprises the face portion 212. The face portion 212 according to the present embodiment is a lower part, or the negative Z-side part, of the holding portion 210 and therefore includes a lower surface, or the negative Z-side surface, of the holding portion 210.

As shown in FIGS. 1 to 4, each of the locked portions 230 has a stopped portion 232 and a guided portion 234. The stopped portion 232 is an upper surface, or the positive Z-side surface, of the locked portion 230, and the guided portion 234 is a lower surface of the locked portion 230. In the present embodiment, the stopped portion 232 is a horizontal plane perpendicular to the Z-direction, and the guided portion 234 is a slope oblique to the Z-direction.

The locked portion 240 has a stopped portion 242 and a guided portion 244 similar to the locked portion 230. The stopped portion 242 is an upper surface of the locked portion 240, and the guided portion 244 is a lower surface of the locked portion 240. The stopped portion 242 is a horizontal plane perpendicular to the Z-direction, and the guided portion 244 is a slope oblique to the Z-direction.

As described above, the connector 20 according to the present embodiment comprises the three stopped portions (the two stopped portions 232 and the one stopped portion 242) and the three guided portions (the two guided portions 234 and the one guided portion 244). The stopped portions 232 are located in the vicinity of a rear end of the connector 20, and the stopped portion 242 is located in the vicinity of a front end of the connector 20.

Referring to FIG. 4, each of the contacts 300 has a spring portion 310 and a contact portion 320. The contact portion 320 is resiliently supported by the spring portion 310 to be movable in the Z-direction. The holding portion 210 holds the contacts 300 arranged in the Y-direction. Each of the contacts 300 has an upper end, or the positive Z-side end, and a lower end (i.e. contact portion 320), wherein the upper end projects upward, or in the positive Z-direction, beyond an upper surface of the holding portion 210, and the contact portion 320 projects downward beyond a lower surface of the face portion 212. For example, when the connector 20 is mounted on a circuit board (not shown), the upper end of the contact 300 is brought into contact with a conductive pattern (not shown) of the circuit board.

Referring to FIGS. 2 and 4, the magnet 410 according to the present embodiment is a bar magnet and is held by the holding portion 210 so that its north pole and its south pole are arranged in the Y-direction. In other words, the connector 20 comprises a magnetic portion 400 consisting of the single magnet 410. The magnetic portion 400 includes a north pole portion 412 which is a magnetic north pole and a south pole portion 414 which is a magnetic south pole. In the present embodiment, the north pole portion 412 is a part of the magnet 410 having the south pole portion 414.

As shown in FIG. 4, the face portion 212 holds the north pole portion 412 and the south pole portion 414 arranged in the Y-direction. In the present embodiment, the north pole portion 412 is located forward of the south pole portion 414. Each of the north pole portion 412 and the south pole portion 414 has an upper surface buried within the holding portion 210 while having a lower surface exposed outward on the lower surface of the face portion 212.

Referring to FIGS. 1, 2 and 4, the mating connector 50 according to the present embodiment comprises a mating housing 500 made of insulator, two mating contacts 600 each made of conductor and a single mating magnet (magnet) 710.

As shown in FIG. 1, the mating housing 500 has a holding portion 510 and a wall 520. The holding portion 510 has a cuboid shape which is long in the Y-direction. The wall 520 projects upward from an upper surface of the holding portion 510 so that the mating connector 50 is formed with a receiving portion 52. The receiving portion 52 is a space surrounded on four sides by the wall 520.

Figure 3:
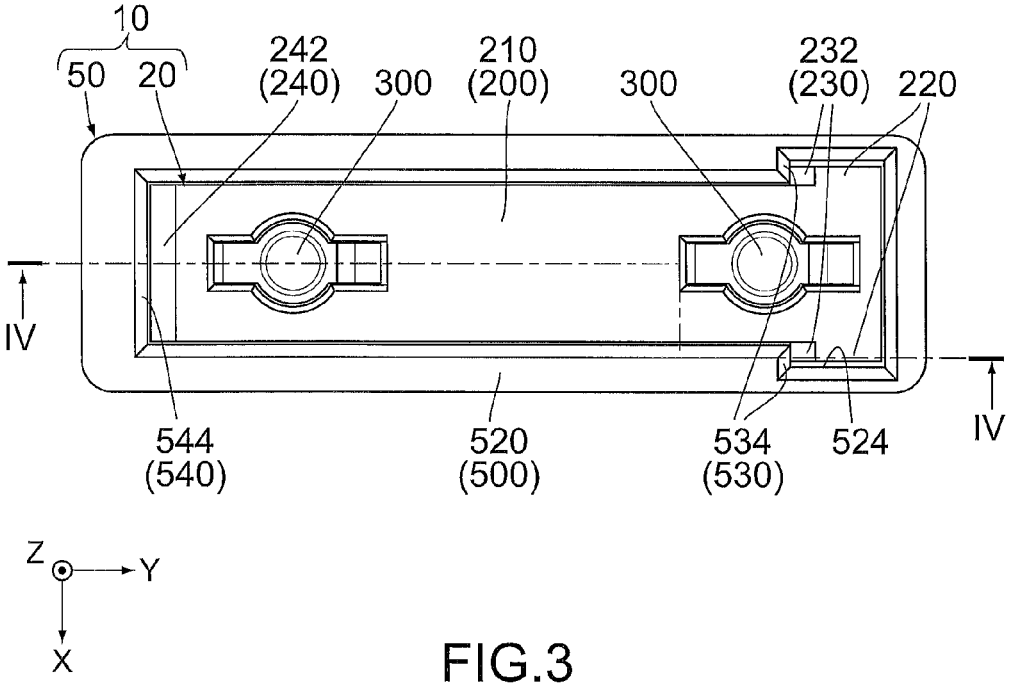
FIG. 3 is a top view showing the connector pair of FIG. 1.

Referring to FIGS. 1 and 4, the holding portion 510 has a mating face portion 512. In other words, the mating connector 50 comprises the mating face portion 512. The mating face portion 512 according to the present embodiment is an upper part, or the positive Z-side part, of the holding portion 210 and is located just under the receiving portion 52. Referring to FIGS. 1 and 3, the wall 520 has an inner face surrounding the receiving portion 52, two recesses 524 and one recess 526. The recesses 524 are located at a rear end of the inner face of the wall 520 while being recessed outward in the X-direction. The recess 526 is located at a lower part of a front end of the inner face of the wall 520 while being recessed in the negative Y-direction.

As shown in FIGS. 1, 3 and 4, the inner face of the wall 520 is formed with two lock portions 530 and one lock portion 540. Each of the lock portions 530 and the lock portion 540 is located at an upper end of the wall 520. The lock portions 530 are formed so as to correspond to the recesses 524, respectively. The lock portions 530 project rearward, or along the positive Y-direction, while protruding inward in the X-direction. The lock portion 540 is located above the recess 526 while projecting rearward.

As shown in FIGS. 3 and 4, each of the lock portions 530 has a stopping portion 532 and a guide portion 534. The stopping portion 532 is a lower surface of the lock portion 530, and the guide portion 534 is an upper surface of the lock portion 530. In the present embodiment, the stopping portion 532 is a horizontal plane perpendicular to the Z-direction, and the guide portion 534 is a slope oblique to the Z-direction.

The lock portion 540 has a stopping portion 542 and a guide portion 544 similar to the lock portion 530. The stopping portion 542 is a lower surface of the lock portion 540, and the guide portion 544 is an upper surface of the lock portion 540. The stopping portion 542 is a horizontal plane perpendicular to the Z-direction, and the guide portion 544 is a slope oblique to the Z-direction.

As described above, the mating connector 50 according to the present embodiment comprises the three stopping portion (the two stopping portions 532 and the one stopping portion 542) and the three guide portions (the two guide portions 534 and the one guide portion 544). The stopping portions 532 are located in the vicinity of a rear end of the mating connector 50, and the stopping portion 542 is located in the vicinity of a front end of the mating connector 50.

Referring to FIG. 4, each of the mating contacts 600 has a mating contact portion 620. The holding portion 510 holds the mating contacts 600 arranged in the Y-direction. Each of the mating contacts 600 has a lower end and an upper end (i.e. mating contact portion 620), wherein the lower end is exposed outward on a lower surface of the holding portion 510, and the mating contact portion 620 is exposed outward on an upper surface of the mating face portion 512. For example, when the mating connector 50 is mounted on a circuit board (not shown), the lower end of the mating contact 600 is electrically and mechanically connected to a conductive pattern (not shown) of the circuit board via soldering, or the like.

Referring to FIGS. 1, 2 and 4, the magnet 710 according to the present embodiment is a bar magnet and is held by the holding portion 510 so that its south pole and its north pole are arranged in the Y-direction. In other words, the mating connector 50 comprises a mating magnetic portion 700 consisting of the single magnet 710. The mating magnetic portion 700 includes a mating north pole portion 712 which is a magnetic north pole and a mating south pole portion 714 which is a magnetic south pole. In the present embodiment, the mating north pole portion 712 is a part of the magnet 710 having the mating south pole portion 714.

As shown in FIG. 4, the mating face portion 512 holds the mating north pole portion 712 and the mating south pole portion 714 arranged in the Y-direction. In the present embodiment, the mating south pole portion 714 is located forward of the mating north pole portion 712. Each of the mating north pole portion 712 and the mating south pole portion 714 has a lower surface exposed outward on the lower surface of the holding portion 510 while having an upper surface exposed outward on the upper surface of the mating face portion 512.

Referring to FIGS. 1 and 4 to 6, when the connector 20 is located at the unmated position (the position shown in FIGS. 1 and 4), the connector 20 is in an unmated state where the connector 20 is not mated with the mating connector 50. If the connector 20 in the unmated state is moved downward, the connector 20 arrives at the first position (the position shown in FIGS. 5 and 6) to change its state into a mated state where the connector 20 is mated with the mating connector 50.

When the connector 20 is moved from the unmated position to the first position, the side portions 220 of the connector 20 are inserted into the recesses 524 of the mating connector 50, respectively, so that the connector 20 is positioned relative to the mating connector 50. In the meantime, the guided portions 234 and the guided portion 244 are guided by the guide portions 534 and the guide portion 544, respectively, so that the connector 20 is smoothly received into the receiving portion 52.

Referring to FIGS. 5 to 8, when the connector 20 is located at the first position (the position shown in FIGS. 5 and 6), the face portion 212 is in contact with the mating face portion 512, and the contact portions 320 of the contacts 300 are pressed against the mating contact portions 620 of the mating contacts 600, respectively. When the connector 20 located at the first position is moved to the second position (the position shown in FIGS. 7 and 8), the connector 20 changes its state into a connected state where the connection between the connector 20 and the mating connector 50 is completed. During this movement, the face portion 212 is kept to be in contact with the mating face portion 512, and the contact portions 320 slide on the mating contact portions 620, respectively. According to the present embodiment, contact reliability between the contact portion 320 and the mating contact portion 620 can be therefore improved. However, the present invention is not limited thereto. For example, the face portion 212 may be apart from the mating face portion 512 in the Z-direction to some extent, provided that the face portion 212 and the mating face portion 512 face each other in the Z-direction not only when the connector 20 is located at the first position but also when the connector 20 is located at the second position.

Figure 6:
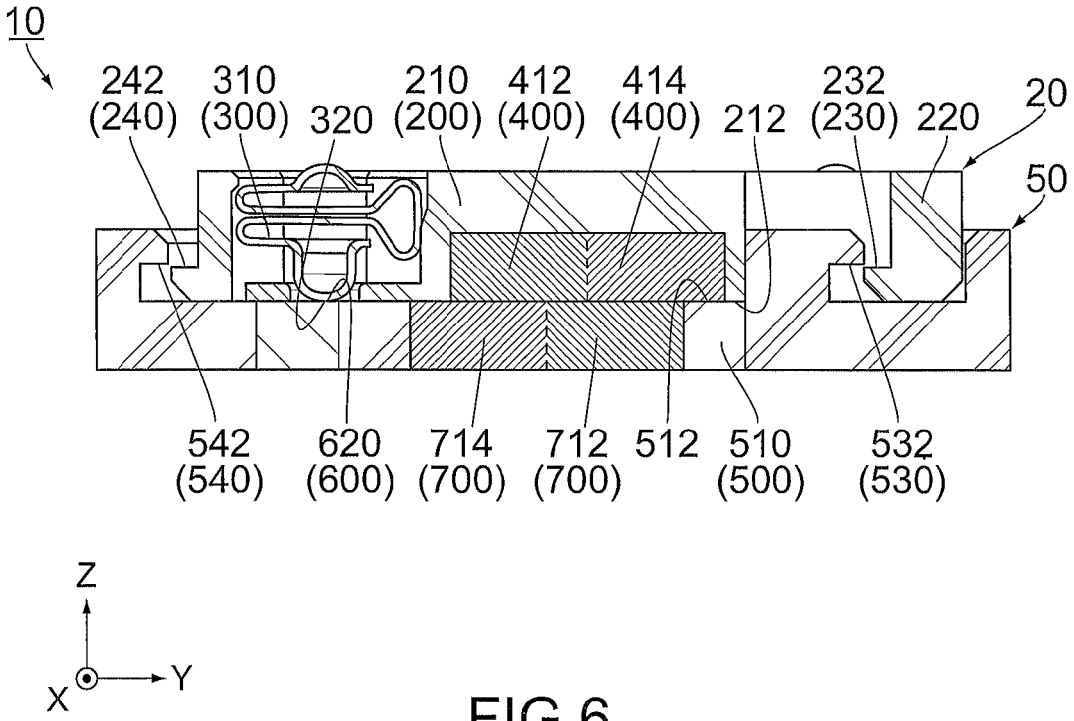
FIG. 6 is a cross-sectional view showing the connector pair of FIG. 5, wherein the illustrated cross-section corresponds to the cross-section of FIG. 4.

As can be seen from FIGS. 2 and 6, when the north pole portion 412 and the mating south pole portion 714 make their projection images into the XY-plane along the Z-direction under the mated state where the connector 20 is located at the first position (the position shown in FIG. 6), the projection image of the north pole portion 412 merely overlaps, but is not equal to, the projection image of the mating south pole portion 714. In other words, when the connector 20 is located at the first position, the north pole portion 412 and the mating south pole portion 714 overlap each other to some extent in a perpendicular plane (XY-plane) perpendicular to the Z-direction. At that time, the south pole portion 414 and the mating north pole portion 712 overlap each other to some extent in the XY-plane. In detail, each of the north pole portion 412, the south pole portion 414, the mating north pole portion 712 and the mating south pole portion 714 has the negative Y-side end (predetermined end) which is located forward thereof. When the connector 20 is located at the first position, the negative Y-side end of the north pole portion 412 is placed rearward of the negative Y-side end of the mating south pole portion 714 in the Y-direction, and the negative Y-side end of the south pole portion 414 is placed rearward of the negative Y-side end of the mating north pole portion 712 in the Y-direction. As a result, the north pole portion 412 and the south pole portion 414 receive attractive forces along the negative Y-direction from the mating south pole portion 714 and the mating north pole portion 712, respectively.

As can be seen from the above explanation, when the connector 20 is located at the first position, the magnetic portion 400 receives a forward force, which urges the connector 20 to be moved toward the second position, from the mating magnetic portion 700. The connector 20 located at the first position can be therefore easily moved forward, or toward the second position, with no external force or with only slight external force applied thereto.

Moreover, according to the present embodiment, when the connector 20 is located at the first position, the north pole portion 412 not only overlaps a rear part, or the positive Y-side part, of the mating south pole portion 714 to some extent but also overlaps a front part, or the negative Y-side part, of the mating north pole portion 712 to some extent. In other words, the negative Y-side end of the north pole portion 412 is placed rearward of the negative Y-side end of the mating south pole portion 714 in the Y-direction, and the positive Y-side end of the north pole portion 412 is placed rearward of the negative Y-side end of the mating north pole portion 712 in the Y-direction. The thus-located north pole portion 412 receives the attractive force along the negative Y-direction from the mating south pole portion 714 while receiving a repulsive force along the negative Y-direction from the mating north pole portion 712. According to the present embodiment, the connector 20 located at the first position can be more easily moved forward.

Referring to FIG. 6, such attractive force and such repulsive force along the negative Y-direction can be also obtained from another structure different from that of the present embodiment. For example, the south pole portion 414 may be located forward of the north pole portion 412. In this structure, the mating north pole portion 712 needs to be located forward of the mating south pole portion 714. In each of the structures described above, when the connector 20 is located at the first position, one of the north pole portion 412 and the south pole portion 414 receives an attractive force from one of the mating north pole portion 712 and the mating south pole portion 714 and receives a repulsive force from a remaining one of the mating north pole portion 712 and the mating south pole portion 714, wherein each of the attractive force and the repulsive force urges the connector 20 to be moved toward the second position.

According to the present embodiment, each of the magnetic portion 400 and the mating magnetic portion 700 is a single permanent bar magnet (the magnet 410 or the magnet 710). The north pole portion 412 and the south pole portion 414 are therefore continuously connected to each other in the Y-direction, and the mating south pole portion 714 and the mating north pole portion 712 are also continuously connected to each other in the Y-direction. In addition, the magnet 410 has a size same as that of the magnet 710. Accordingly, a simple arrangement, in which the magnet 410 and the magnet 710 under the mated state overlap each other to some extent, causes the attractive force and the repulsive force each of which urges the connector 20 to be moved toward the second position. According to the present embodiment, a structure, in which the single magnet 410 and the single magnet 710 are simply arranged, can exert a magnet force to connect the connector 20 with the mating connector 50.

Figure 8:
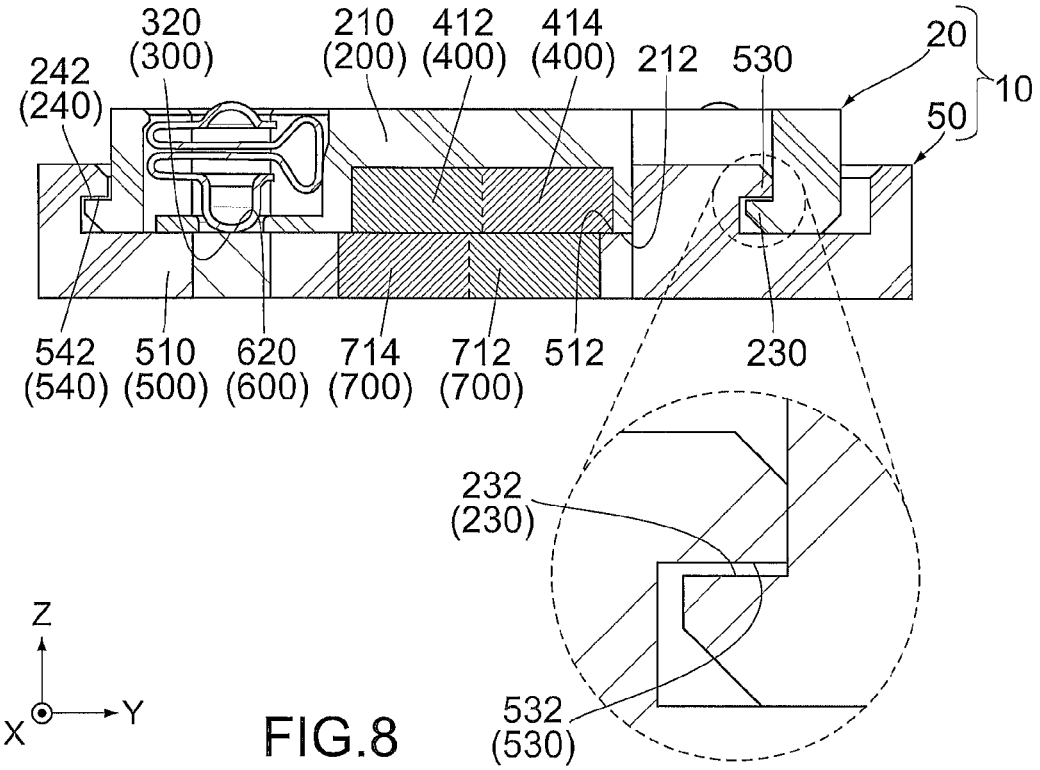
FIG. 8 is a cross-sectional view showing the connector pair of FIG. 7, wherein the illustrated cross-section corresponds to the cross-section of FIG. 4, and a vicinity of a locked portion of the connector (the part encircled by dashed line) is enlarged to be illustrated.

As can be seen from FIGS. 6 and 8, when the connector 20 is moved from the first position to the second position, the magnetic portion 400 is moved linearly forward, or moved toward the negative Y-side end of the mating connector 50 away from the positive Y-side end of the mating connector 50 along the Y-direction. During this movement, an overlapped region in the XY-plane between the north pole portion 412 and the mating south pole portion 714 gradually increases in its size, and another overlapped region in the XY-plane between the south pole portion 414 and the mating north pole portion 712 gradually increases in its size. In detail, as the connector 20 approaches the second position, the negative Y-side end of the north pole portion 412 approaches the negative Y-side end of the mating south pole portion 714, and the negative Y-side end of the south pole portion 414 approaches the negative Y-side end of the mating north pole portion 712. In the meantime, the north pole portion 412 is moved to be away from the mating north pole portion 712 as a whole. As a result, when the connector 20 is located at the second position, the magnetic portion 400 receives a force, which binds the connector 20 at the second position, from the mating magnetic portion 700. In other words, the magnetic force maintains the connected state between the connector 20 and the mating connector 50.

As shown in FIG. 8, when the connector 20 is located at the second position, the stopping portions 532 and the stopping portion 542 face the stopped portions 232 and the stopped portion 242 in the Z-direction, respectively. When the connector 20 is moved upward, the stopped portions 232 and the stopped portion 242 are stopped by the stopping portions 532 and the stopping portion 542, respectively. This arrangement prevents a removal of the connector 20 from the mating connector 50 only along the Z-direction. In particular, the connector pair 10 according to the present embodiment comprises a plurality of stopping pairs each of which includes the stopped portion (the stopped portion 232 or the stopped portion 242) and the stopping portion (the stopping portion 532 or the stopping portion 542). Moreover, at least two of the stopping pairs are apart from each other in the Y-direction. The thus-arranged plurality of the stopping pairs securely lock the connected state between the connector 20 and the mating connector 50. However, the connector pair 10 may comprise only one of the stopping pairs.

In the present embodiment, when the connector 20 is located at the second position, the stopping portions 532 and the stopping portion 542 are slightly apart from the stopped portions 232 and the stopped portion 242 in the Z-direction, respectively. However, the present invention is not limited thereto. For example, the stopping portions 532 and the stopping portion 542 may be in contact with the stopped portions 232 and the stopped portion 242 in the Z-direction, respectively.

The present invention can be variously modified in addition to the already explained embodiment and modifications. Hereafter, explanation will be made about the other embodiments of the present invention, in particular, mainly about their differences from the aforementioned embodiment.

Second Embodiment

Figure 9:
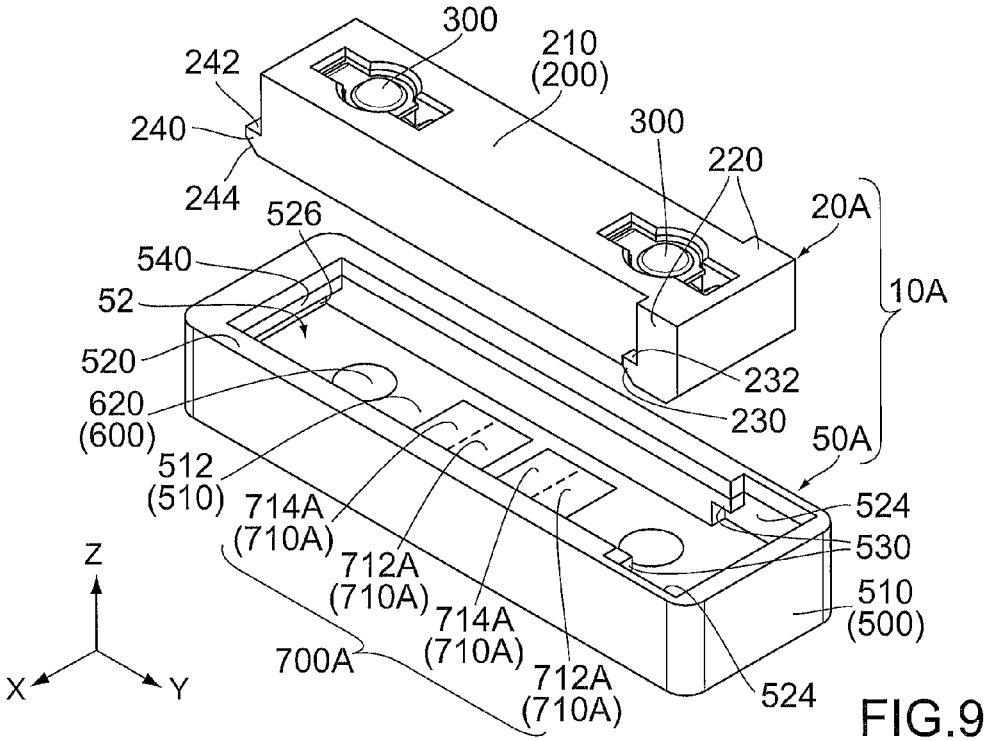
FIG. 9 is a perspective view showing a connector pair according to a second embodiment of the present invention, wherein a connector and a mating connector thereof are in an unmated state.
Figure 10:
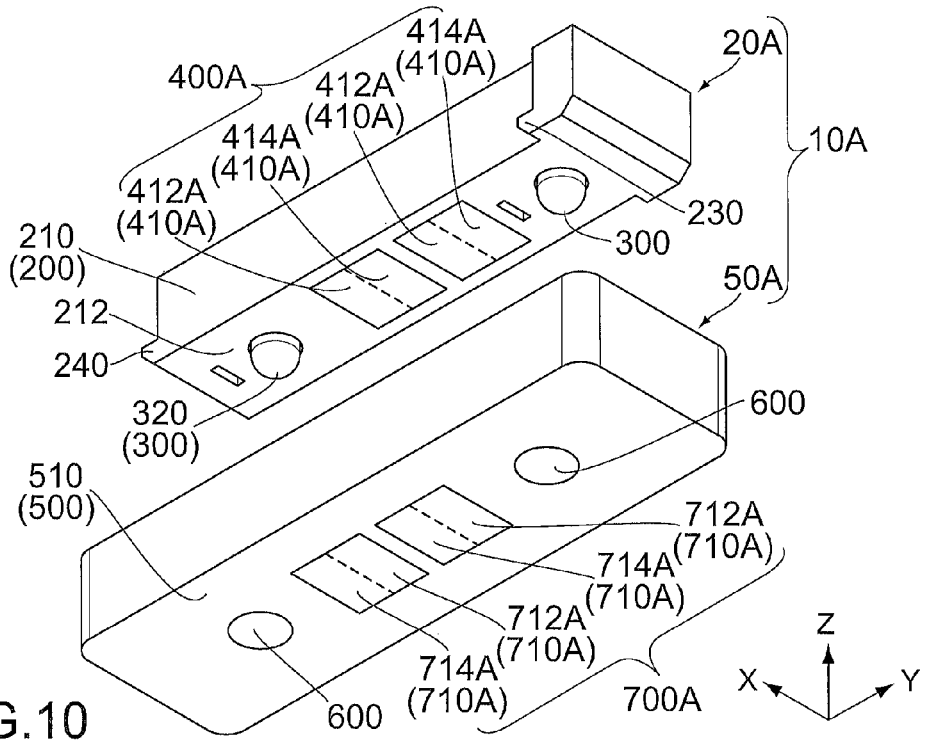
FIG. 10 is another perspective view showing the connector pair of FIG. 9.
Figure 11:
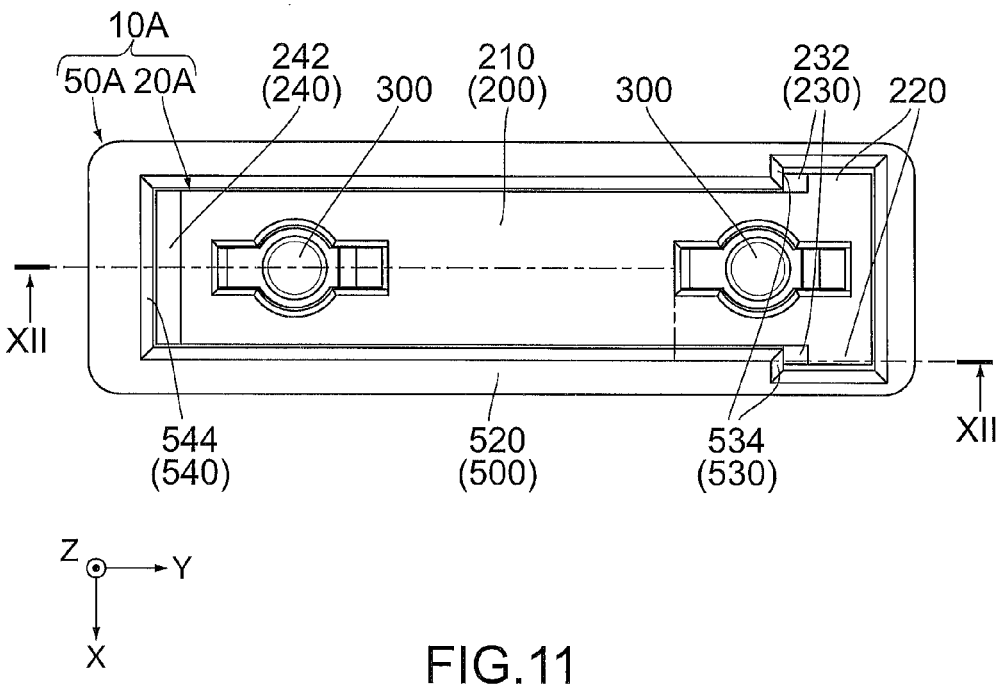
FIG. 11 is a top view showing the connector pair of FIG. 9, wherein the connector is located at a first position.
Figure 12:
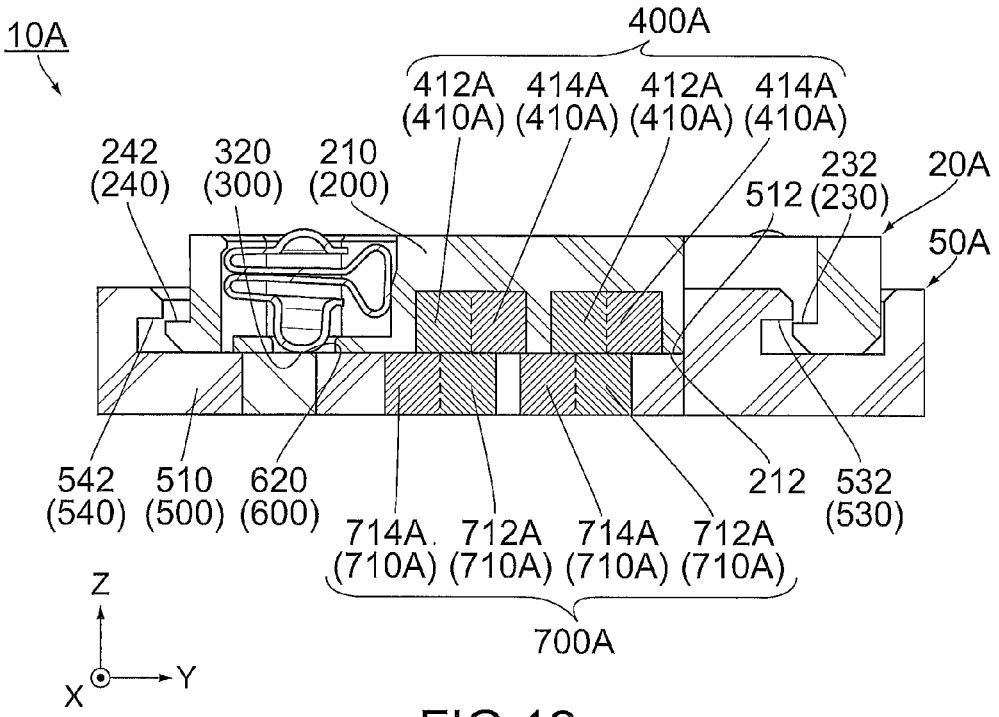
FIG. 12 is a cross-sectional view showing the connector pair of FIG. 11, taken along line XII-XII.
Figure 13:
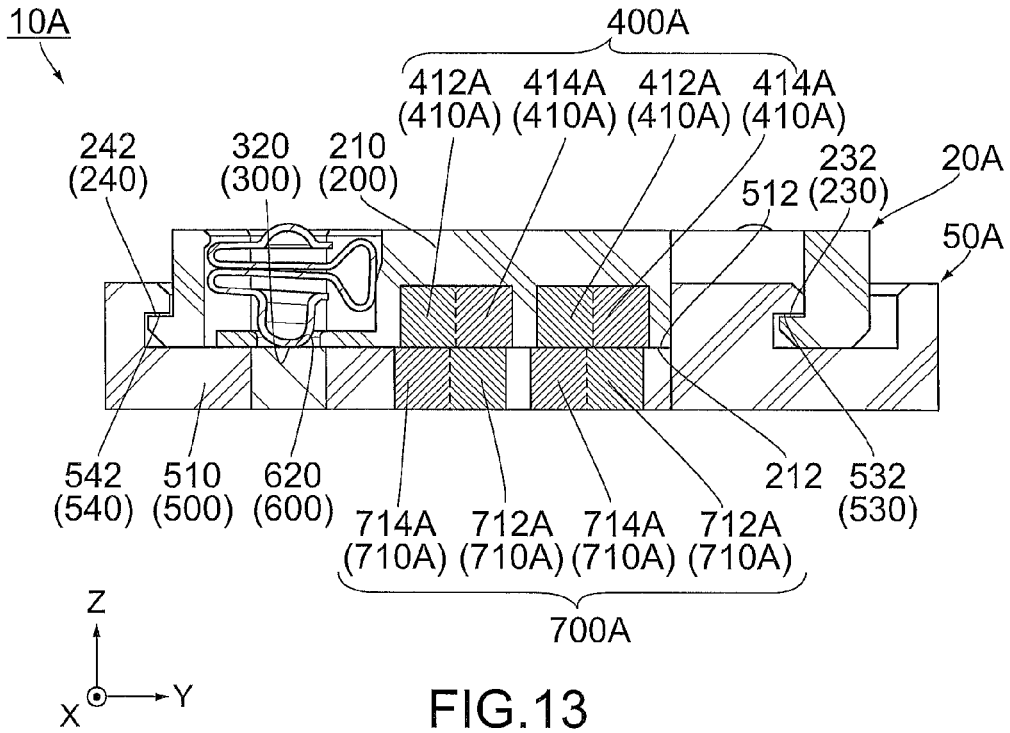
FIG. 13 is a cross-sectional view showing the connector pair of FIG. 12, wherein the connector is located at a second position.

Referring to FIGS. 9 to 11, a connector pair 10A according to a second embodiment of the present invention comprises a connector 20A and a mating connector 50A. Referring to FIGS. 9, 12 and 13, a movement of the connector 20A from an unmated position (the position shown in FIG. 9) to a first position (the position shown in FIG. 12) along the Z-direction causes the connector 20A to be mated with the mating connector 50A, and another movement of the connector 20A from the first position to a second position (the position shown in FIG. 13) along the Y-direction completes a connection between the connector 20A and the mating connector 50A.

Referring to FIGS. 9 and 10 as well as FIGS. 1 and 2, the connector 20A according to the present embodiment has a structure same as that of the connector 20 and works similar to the connector 20 except that the connector 20A comprises two magnets 410A different from the magnet 410. The mating connector 50A according to the present embodiment also has a structure same as that of the mating connector 50 and works similar to the mating connector 50 except that the mating connector 50A comprises two mating magnets (magnets) 710A different from the magnet 710.

Referring to FIGS. 9 and 10 as well as FIG. 2, each of the magnets 410A according to the present embodiment is a bar magnet which is same as the magnet 410 except that the magnets 410A has a size in the Y-direction smaller than that of the magnet 410. Each of the magnets 410A is arranged similar to the magnet 410. In detail, each of the magnets 410A has a north pole portion 412A and a south pole portion 414A arranged in the Y-direction. Each of the north pole portions 412A is a part of the magnet 410A having the corresponding south pole portion 414A. The connector 20A according to the present embodiment comprises a magnetic portion 400A consisting of the two north pole portions 412A each of which is a magnetic north pole and the two south pole portions 414A each of which is a magnetic south pole. The face portion 212 holds the north pole portions 412A and the south pole portions 414A alternately arranged in the Y-direction. In detail, in the present embodiment, the north pole portion 412A is located forward of the south pole portion 414A in each of the magnets 410A.

Each of the magnets 710A according to the present embodiment is a bar magnet same as the magnet 410A. Each of the magnets 710A has a mating north pole portion 712A and a mating south pole portion 714A arranged in the Y-direction. Each of the mating north pole portions 712A is a part of the magnet 710A having the corresponding mating south pole portion 714A. The mating connector 50A according to the present embodiment comprises a mating magnetic portion 700A consisting of the two mating north pole portions 712A each of which is a magnetic north pole and the two mating south pole portions 714A each of which is a magnetic south pole. The mating face portion 512 holds the mating north pole portions 712A and the mating south pole portions 714A alternately arranged in the Y-direction. In detail, in the present embodiment, the mating south pole portion 714A is located forward of the mating north pole portion 712A in each of the magnets 710A.

As can be seen from FIGS. 12 and 13, the face portion 212 and the mating face portion 512 face each other in the Z-direction not only when the connector 20A is located at the first position (the position shown in FIG. 12) but also when the connector 20A is located at the second position (the position shown in FIG. 13). The two magnets 410A positionally correspond to the two magnets 710A, respectively. When the connector 20A is located at the first position, the north pole portion 412A and the corresponding mating south pole portion 714A overlap each other to some extent in the XY-plane. In addition, the south pole portion 414A and the corresponding mating north pole portion 712A overlap each other to some extent in the XY-plane. As a result, the magnetic portion 400A receives an attractive force along the negative Y-direction from the mating magnetic portion 700A similar to the first embodiment.

Moreover, similar to the first embodiment, when the connector 20A is located at the first position, each of the north pole portions 412A receives the attractive force along the negative Y-direction from the corresponding mating south pole portion 714A while receiving a repulsive force along the negative Y-direction from the corresponding mating north pole portion 712A. However, the present invention is not limited thereto. For example, the magnetic portion 400A and the mating magnetic portion 700A may be arranged so that each of the south pole portions 414A receives both the attractive force along the negative Y-direction and the repulsive force along the negative Y-direction.

As can be seen from the above explanation, when the connector 20A is located at the first position, the magnetic portion 400A receives a forward force, which urges the connector 20A to be moved toward the second position, from the mating magnetic portion 700A similar to the first embodiment. The connector 20A located at the first position can be therefore easily moved forward, or toward the second position.

The connector 20A according to the present embodiment comprises a plurality of pairs (magnetic pairs) each of which consists of the north pole portion 412A and the south pole portion 414A. Moreover, the mating connector 50A comprises a plurality of pairs (mating magnetic pairs) each of which consists of the mating north pole portion 712A and the mating south pole portion 714A. The magnetic pairs are arranged in the Y-direction so as to correspond to the mating magnetic pairs arranged in the Y-direction, respectively. This arrangement allows the connector 20A to be moved more accurately along the Y-direction.

According to the present embodiment, similar to the first embodiment, a simple arrangement, in which the magnet 410A and the corresponding magnet 710A under the mated state overlap each other to some extent, causes the attractive force and the repulsive force each of which urges the connector 20A to be moved toward the second position. According to the present embodiment, a structure, in which the two magnets 410A and the two magnets 710A are simply arranged, can exert a magnet force to connect the connector 20A with the mating connector 50A.

When the connector 20A is moved from the first position to the second position, an overlapped region in the XY-plane between the north pole portion 412A and the corresponding mating south pole portion 714A gradually increases in its size, and another overlapped region in the XY-plane between the south pole portion 414A and the corresponding mating north pole portion 712A gradually increases in its size. In detail, as the connector 20A approaches the second position, the negative Y-side end of the north pole portion 412A approaches the negative Y-side end of the corresponding mating south pole portion 714A, and the negative Y-side end of the south pole portions 414A approaches the negative Y-side end of the corresponding mating north pole portion 712A. In addition, the north pole portion 412A is moved to be away from the corresponding mating north pole portion 712A as a whole. As a result, when the connector 20A is located at the second position, the magnetic portion 400A receives a force, which binds the connector 20A at the second position, from the mating magnetic portion 700A.

Figure 14:
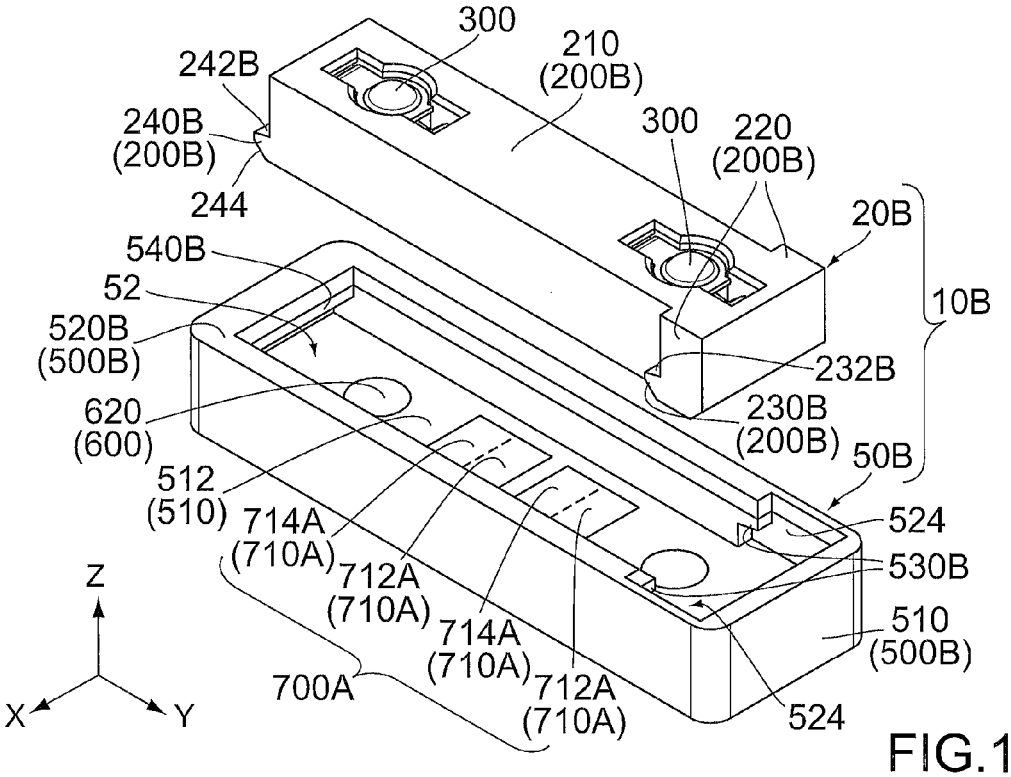
FIG. 14 is a perspective view showing a connector pair according to a modification of the connector pair of FIG. 9, wherein a connector and a mating connector thereof are in an unmated state.
Figure 15:
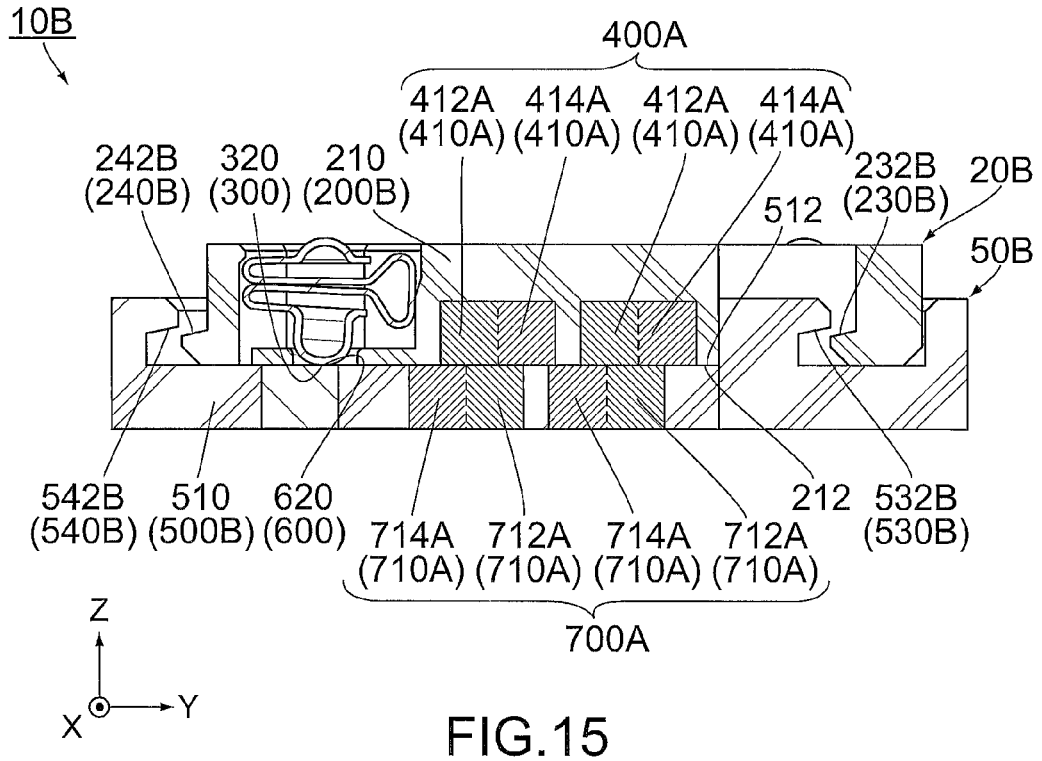
FIG. 15 is a cross-sectional view showing the connector pair of FIG. 14, wherein the illustrated cross-section corresponds to the cross-section of FIG. 12, and the connector is located at a first position.
Figure 16:
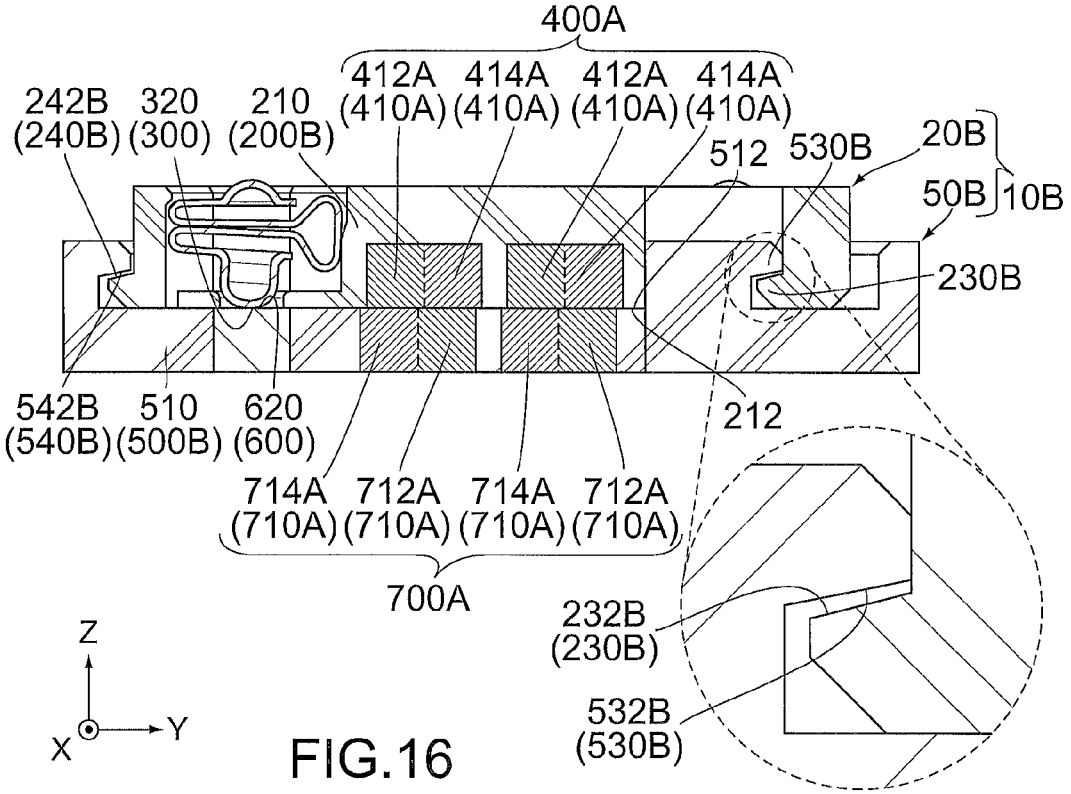
FIG. 16 is a cross-sectional view showing the connector pair of FIG. 15, wherein the connector is located at a second position, and a vicinity of a locked portion of the connector (the part encircled by dashed line) is enlarged to be illustrated.

Referring to FIGS. 14 to 16 as well as FIG. 9, a connector pair 10B is a modification of the connector pair 10A described above. The connector pair 10B comprises a connector 20B and a mating connector 50B. The connector 20B has a structure same as that of the connector 20A except that the connector 20B comprises a housing 200B partially different from the housing 200. The mating connector 50B also has a structure same as that of the mating connector 50A except that the mating connector 50B comprises a mating housing 500B partially different from the mating housing 500.

In detail, the housing 200B has a structure same as that of the housing 200 except that the housing 200B has two locked portions 230B and one locked portion 240B instead of the locked portions 230 and the locked portion 240. The mating housing 500B has a structure same as that of the mating housing 500 except that the mating housing 500B has a wall 520B formed with two lock portions 530B and one lock portion 540B instead of the wall 520 formed with the lock portions 530 and the lock portion 540.

Referring to FIGS. 14 to 16, each of the locked portions 230B has a stopped portion 232B and the guided portion 234. The locked portion 240B has a stopped portion 242B and the guided portion 244. Each of the stopped portions 232B and the stopped portion 242B according to the present embodiment is a slope oblique to the Z-direction. Moreover, each of the lock portions 530B has a stopping portion 532B and the guide portion 534. The lock portion 540B has a stopping portion 542B and the guide portion 544. Each of the stopping portions 532B and the stopping portion 542B according to the present embodiment is a slope oblique to the Z-direction.

Referring to FIG. 16, when the connector 20B is located at the second position, each of the stopped portions 232B and the stopping portions 532B extends rearward while sloping upward. At that time, each of the stopped portion 242B and the stopping portion 542B extends rearward while sloping upward. When the thus-formed connector 20B is moved rearward in a removal operation of the connector 20B, the connector 20B is moved obliquely upward so that a simple operation enables an easy removal of the connector 20B from the mating connector 50B. Moreover, even if the connector 20B is pulled upward with a strong force, a part of the force acts on the connector 20B as an obliquely upward force to move the connector 20B rearward. The locked portions 230B, the locked portion 240B, the lock portions 530B and the lock portion 540B can be therefore prevented from being damaged.

The present modification can be further modified. For example, one of the stopped portion 232B and the corresponding stopping portion 532B may be a horizontal plane. In other words, it is sufficient that, when the connector 20B is located at the second position, at least one of the stopped portion (the stopped portion 232B or the stopped portion 242B) and the corresponding stopping portion (the stopping portion 532B or the stopping portion 542B) extends along an oblique direction oblique to both the Z-direction and the Y-direction. The thus-formed stopped portion and the stopping portion allow the connector 20B to be removed from the mating connector 50B along the oblique direction.

In the embodiments described above, the second direction, or a movement direction along which the connector is moved from the first position to the second position, is the linearly extending Y-direction (front-rear direction). Moreover, the movement of the connector from the first position to the second position is a linear movement along the second direction (Y-direction). However, the present invention is not limited thereto. For example, as explained in the following embodiments, the movement direction (second direction) along which the connector is moved from the first position to the second position may be a circumference direction about a central axis extending in parallel to the Z-direction. In such a case, the movement of the connector from the first position to the second position may be a rotational movement about this central axis.

Third Embodiment

Figure 17:
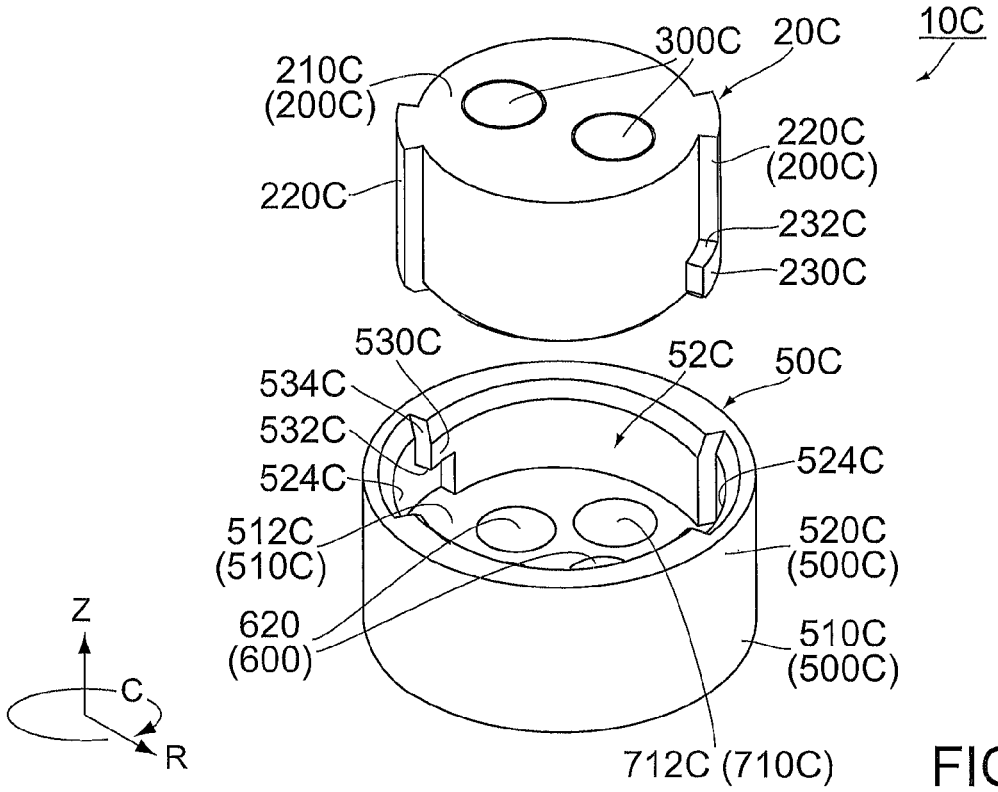
FIG. 17 is a perspective view showing a connector pair according to a third embodiment of the present invention, wherein a connector and a mating connector thereof are in an unmated state.
Figure 18:
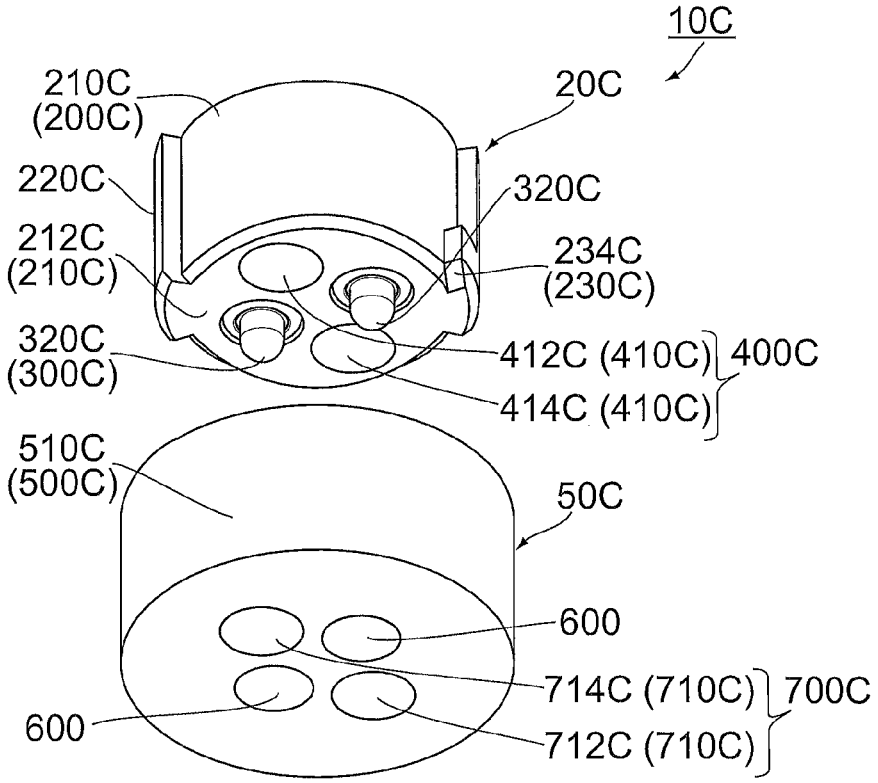
FIG. 18 is another perspective view showing the connector pair of FIG. 17.
Figure 19:
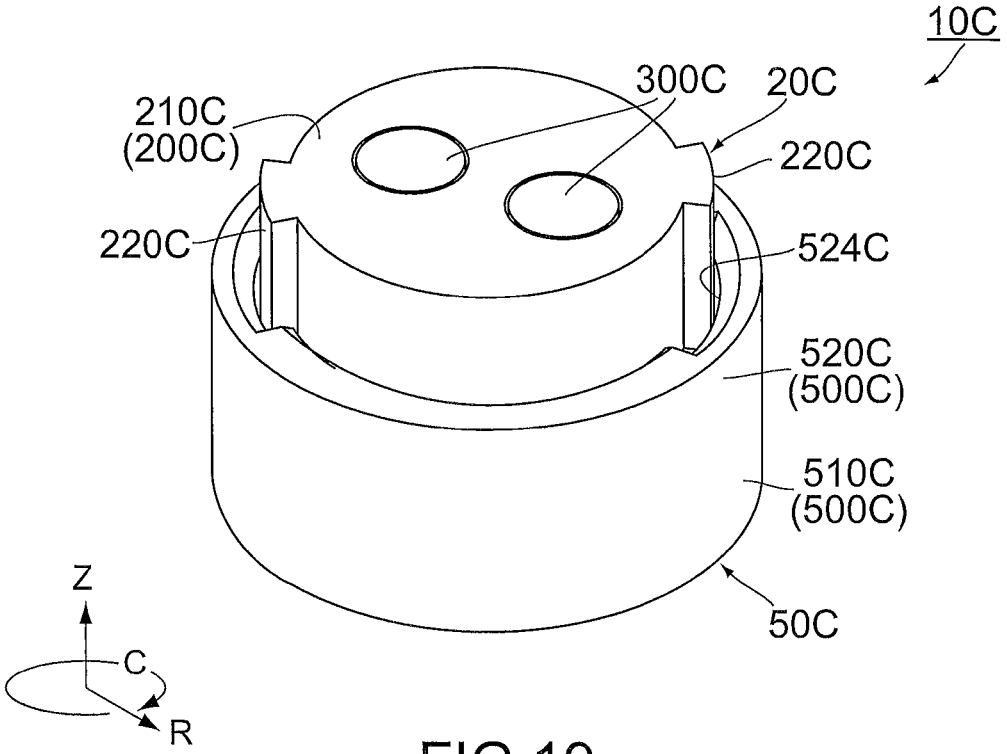
FIG. 19 is a perspective view showing the connector pair of FIG. 17, wherein the connector is located at a first position.
Figure 20:
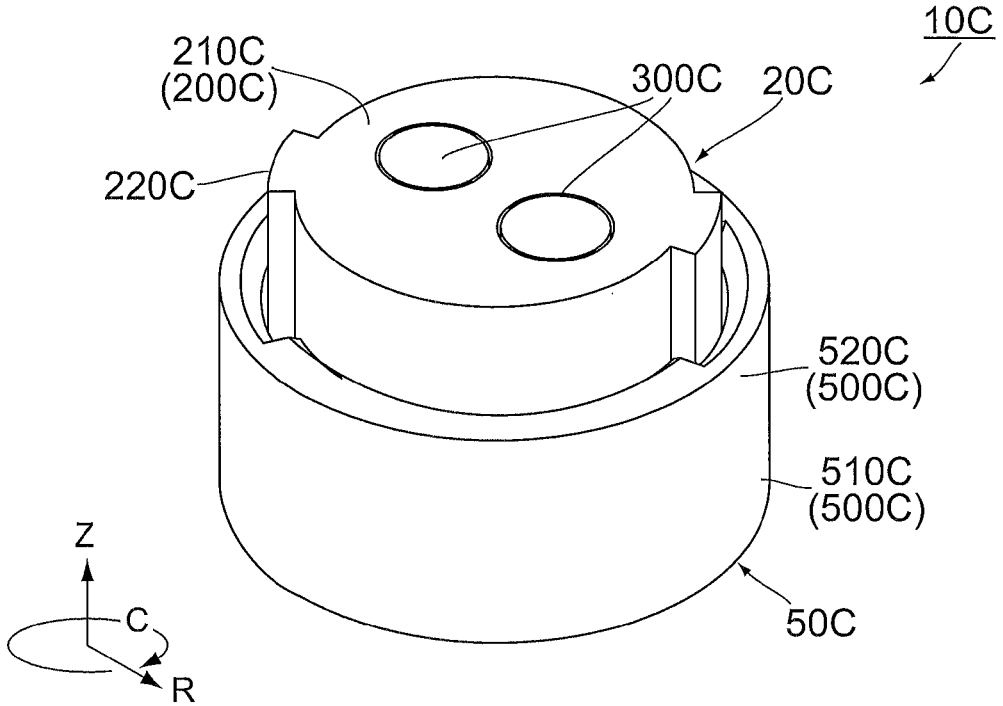
FIG. 20 is a perspective view showing the connector pair of FIG. 17, wherein the connector is located at a second position.

As shown in FIGS. 17 and 18, a connector pair 10C according to a third embodiment of the present invention comprises a connector 20C and a mating connector 50C. Referring to FIGS. 17, 19 and 20, a movement of the connector 20C from an unmated position (the position shown in FIG. 17) to a first position (the position shown in FIG. 19) along an upper-lower direction (Z-direction: first direction) causes the connector 20C to be mated with the mating connector 50C. Then, another movement of the connector 20C from the first position to a second position (the position shown in FIG. 20) along a circumference direction (C-direction: second direction) perpendicular to the Z-direction completes a connection between the connector 20C and the mating connector 50C.

The connector 20C according to the present embodiment comprises a housing 200C made of insulator, two contacts 300C each made of conductor and two magnets 410C.

As shown in FIGS. 17 and 18, the housing 200C has a holding portion 210C, two side portions 220C and two locked portions 230C. The holding portion 210C has a cylindrical shape which has an axis in parallel to the Z-direction as its central axis. The holding portion 210C has a face portion 212C. The face portion 212C is a lower part of the holding portion 210C and therefore includes a lower surface of the holding portion 210C. Each of the side portions 220C protrudes outward in a radial direction (R-direction) from a circumference surface of the holding portion 210C. The side portions 220C are located in rotational symmetry with each other around the central axis of the holding portion 210C. The locked portions 230C are located at lower ends of the side portions 220C, respectively, while projecting from the side portions 220C in the circumference direction, respectively. Each of the locked portions 230C has a stopped portion 232C and a guided portion 234C. In the present embodiment, the stopped portion 232C is a horizontal plane perpendicular to the Z-direction, and the guided portion 234C is a slope oblique to the Z-direction.

Each of the contacts 300C has a contact portion 320C. The holding portion 210C holds the contacts 300C arranged in the circumference direction. Each of the contacts 300C is held so as to pierce the holding portion 210C in the Z-direction.

Referring to FIG. 18, each of the magnets 410C according to the present embodiment is a cylindrical permanent bar magnet. One of the magnets 410C is held by the holding portion 210C so as to have its north pole located under its south pole, and a remaining one of the magnets 410C is held by the holding portion 210C so as to have its south pole located under its north pole. Accordingly, the connector 20C comprises a magnetic portion 400C consisting of two magnetic poles, namely, the north pole of one of the magnets 410C and the south pole of a remaining one of the magnets 410C. The magnetic portion 400C therefore includes a north pole portion 412C which is a magnetic north pole and a south pole portion 414C which is a magnetic south pole. The face portion 212C holds the north pole portion 412C and the south pole portion 414C arranged in the circumference direction. In detail, the north pole portion 412C and the south pole portion 414C are arranged in rotational symmetry with each other around the central axis of the holding portion 210C. According to the present embodiment, the north pole portion 412C is a part of the magnet 410C which is separated from the magnet 410C having the south pole portion 414C.

Referring to FIGS. 17 and 18, the mating connector 50C according to the present embodiment comprises a mating housing 500C made of insulator, the two mating contacts 600 and two mating magnets (magnets) 710C.

The mating housing 500C has a holding portion 510C and a wall 520C. The holding portion 510C has a cylindrical shape which has an axis in parallel to the Z-direction as its central axis. The wall 520C projects upward from an upper surface of the holding portion 510C so that the mating connector 50C is formed with a receiving portion 52C. The receiving portion 52C is a space surrounded by the wall 520C.

Referring to FIG. 17, the holding portion 510C has a mating face portion 512C. The mating face portion 512C is an upper part of the holding portion 210C and is located just under the receiving portion 52C. The wall 520C has an inner face surrounding the receiving portion 52C and two recesses 524C. Each of the recesses 524C is recessed outward in the radial direction. The recesses 524C are located in rotational symmetry with each other around the central axis of the wall 520C. The recesses 524C are formed with lock portions 530C, respectively. The lock portions 530C are located at upper ends of the recesses 524C, respectively. Each of the lock portions 530C projects in the circumference direction while protruding inward in the radial direction. Each of the lock portions 530C has a stopping portion 532C and a guide portion 534C. In the present embodiment, the stopping portion 532C is a horizontal plane perpendicular to the Z-direction, and the guide portion 534C is a slope oblique to the Z-direction.

The holding portion 510C holds the mating contacts 600 arranged in the circumference direction. Each of the mating contacts 600 has a lower end and an upper end (mating contact portion 620), wherein the lower end is exposed outward on a lower surface of the holding portion 510C, and the mating contact portion 620 is exposed outward on an upper surface of the mating face portion 512C.

Each of the magnets 710C according to the present embodiment is a cylindrical permanent bar magnet. One of the magnets 710C is held by the holding portion 510C so as to have its north pole located over its south pole, and a remaining one of the magnets 710C is held by the holding portion 510C so as to have its south pole located over its north pole. Accordingly, the mating connector 50C comprises a mating magnetic portion 700C consisting of two magnetic poles, namely, the north pole of one of the magnets 710C and the south pole of a remaining one of the magnets 710C. The mating magnetic portion 700C therefore includes a mating north pole portion 712C which is a magnetic north pole and a mating south pole portion 714C which is a magnetic south pole. The mating face portion 512C holds the mating north pole portion 712C and the mating south pole portion 714C arranged in the circumference direction. In detail, the mating south pole portion 714C and the mating north pole portion 712C are arranged in rotational symmetry with each other around the central axis of the holding portion 510C. According to the present embodiment, the mating north pole portion 712C is a part of the magnet 710C which is separated from the magnet 710C having the mating south pole portion 714C.

Referring to FIGS. 17, 19 and 20, when the side portions 220C of the connector 20C are inserted into the recesses 524C of the mating connector 50C, respectively, and moved downward, the guided portions 234C are guided by the guide portions 534C, respectively, so that the connector 20C is moved from the unmated position (the position shown in FIG. 17) to the first position (the position shown in FIG. 19). When the connector 20C is located at the first position, the face portion 212C of the connector 20C and the mating face portion 512C of the mating connector 50C face each other in the Z-direction. The face portion 212C and the mating face portion 512C are kept to face each other in the Z-direction during the movement of the connector 20C from the first position to the second position (the position shown in FIG. 20).

When the connector 20C is located at the first position, the north pole portion 412C and the mating south pole portion 714C overlap each other to some extent in a horizontal plane (perpendicular plane) perpendicular to the Z-direction. At that time, the south pole portion 414C and the mating north pole portion 712C overlap each other in the perpendicular plane. In detail, each of the north pole portion 412C, the south pole portion 414C, the mating north pole portion 712C and the mating south pole portion 714C has its predetermined end which is located rotationally forward thereof along the circumference direction, or along a clockwise direction in FIG. 17. The predetermined end of the north pole portion 412C is placed rotationally rearward of the predetermined end of the mating south pole portion 714C in the circumference direction. Similarly, the predetermined end of the south pole portion 414C is placed rotationally rearward of the predetermined end of the mating north pole portion 712C in the circumference direction. As a result, the magnetic portion 400C receives an attractive force along the circumference direction from the mating magnetic portion 700C. In other words, when the connector 20C is located at the first position, the magnetic portion 400C receives, from the mating magnetic portion 700C, a force which is along the circumference direction and which therefore urges the connector 20C to be moved toward the second position. According to the present embodiment, a structure, in which the magnets 410C and the magnets 710C are simply arranged, can exert a magnet force to connect the connector 20C with the mating connector 50C.

When the connector 20C is moved from the first position to the second position, the magnetic portion 400C is moved clockwise as seen from above. In detail, each of the north pole portion 412C and the south pole portion 414C of the magnetic portion 400C is moved rotationally forward along the circumference direction. During this movement, an overlapped region between the north pole portion 412C and the mating south pole portion 714C in the perpendicular plane gradually increases in its size, and another overlapped region between the south pole portion 414C and the mating north pole portion 712C in the perpendicular plane gradually increases in its size. In detail, as the connector 20C approaches the second position, the predetermined end of the north pole portion 412C approaches the predetermined end of the mating south pole portion 714C, and the predetermined end of the south pole portion 414C approaches the predetermined end of the mating north pole portion 712C. When the connector 20C is located at the second position, the magnetic portion 400C receives a force, which binds the connector 20C at the second position, from the mating magnetic portion 700C.

When the connector 20C is located at the second position, the stopping portions 532C face the stopped portions 232C in the Z-direction, respectively. This arrangement prevents a removal of the connector 20C from the mating connector 50C only along the Z-direction. In particular, the connector pair 10C according to the present embodiment comprises two stopping pairs each of which includes the stopped portion 232C and the stopping portion 532C. Moreover, the stopping pairs are apart from each other in the circumference direction. The thus-arranged plurality of the stopping pairs securely lock the connected state between the connector 20C and the mating connector 50C.

Forth Embodiment

Figure 21:
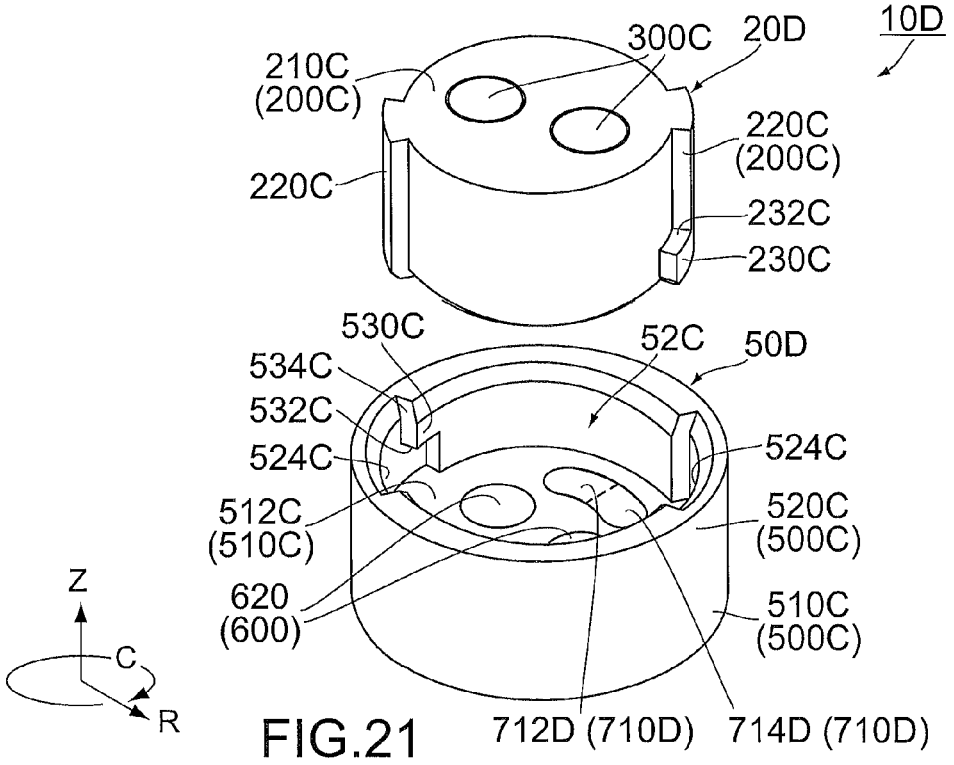
FIG. 21 is a perspective view showing a connector pair according to a forth embodiment of the present invention, wherein a connector and a mating connector thereof are in an unmated state.
Figure 25:
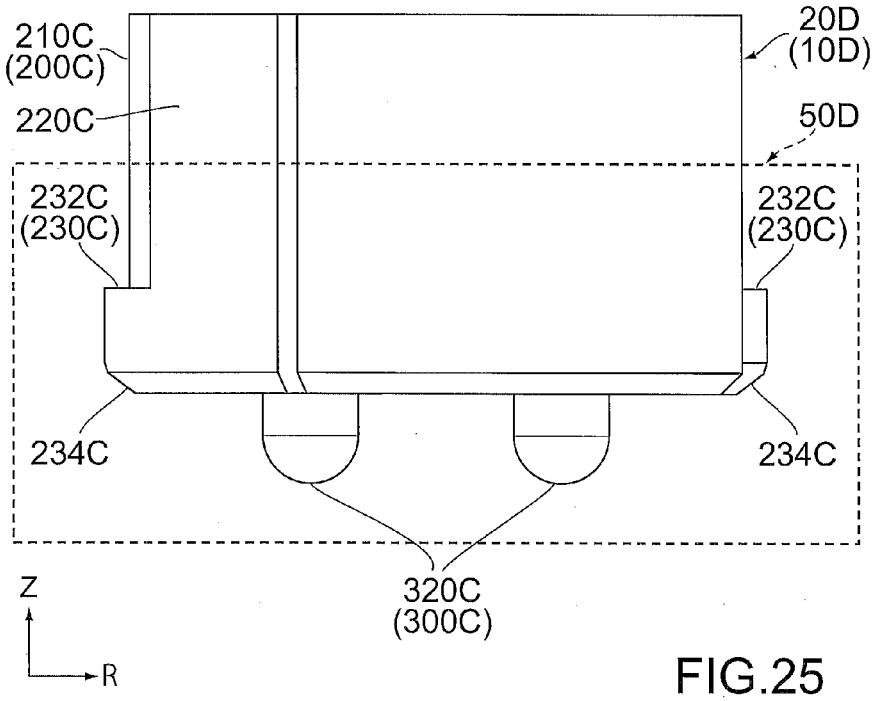
FIG. 25 is a side view showing the connector pair of FIG. 23, wherein the mating connector is not illustrated except its outline illustrated by dashed line.
Figure 26:
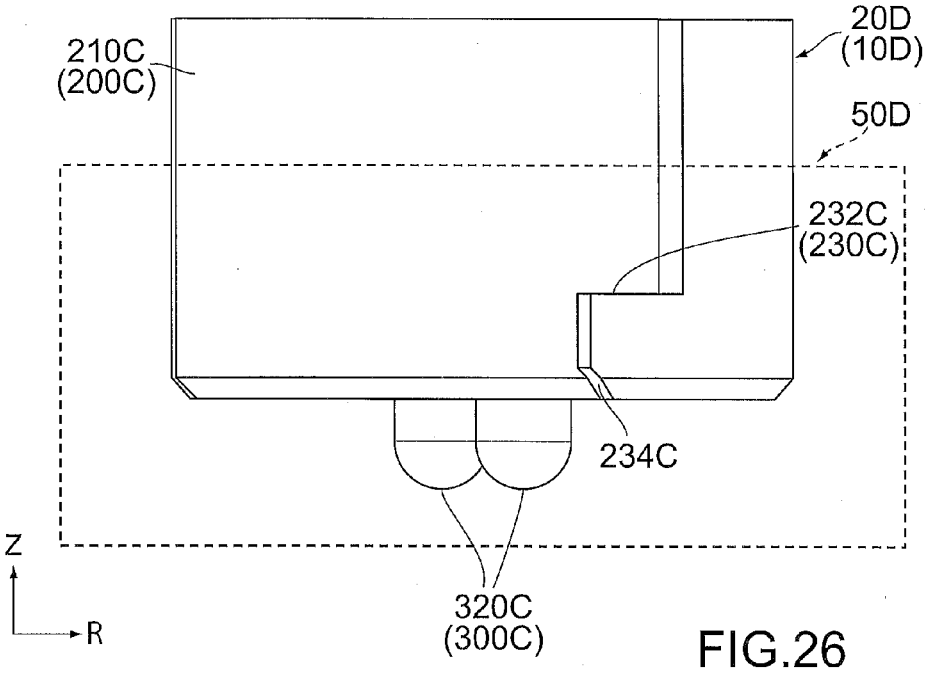
FIG. 26 is a side view showing the connector pair of FIG. 25, wherein the connector is located at a second position.
Figure 27:
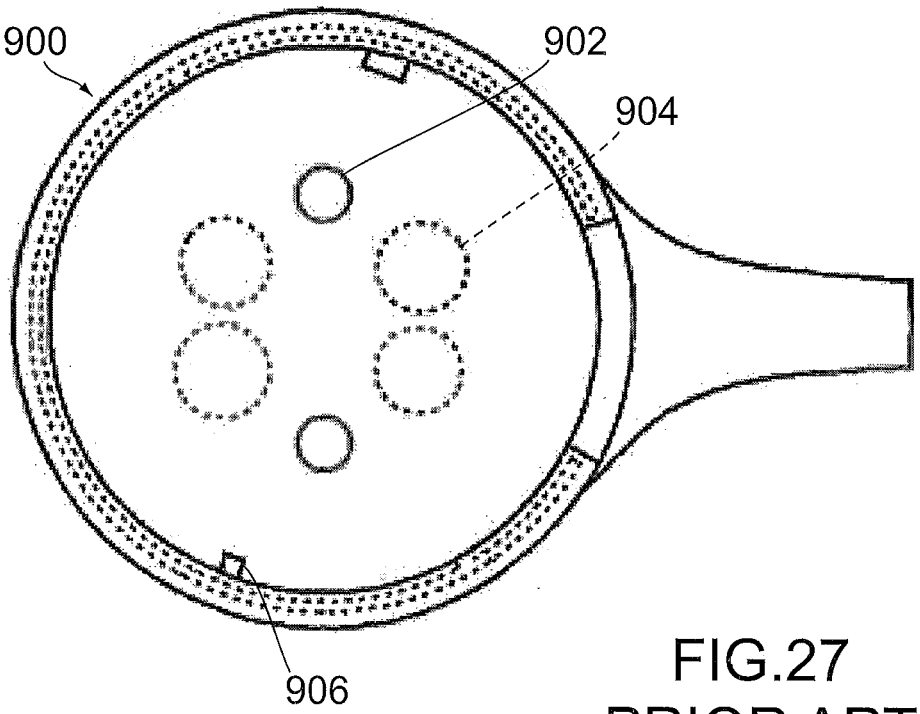
FIG.27 PRIOR ART
FIG. 27 is a bottom view showing a current tap housing 900 of Patent Document 1.
Figure 28:
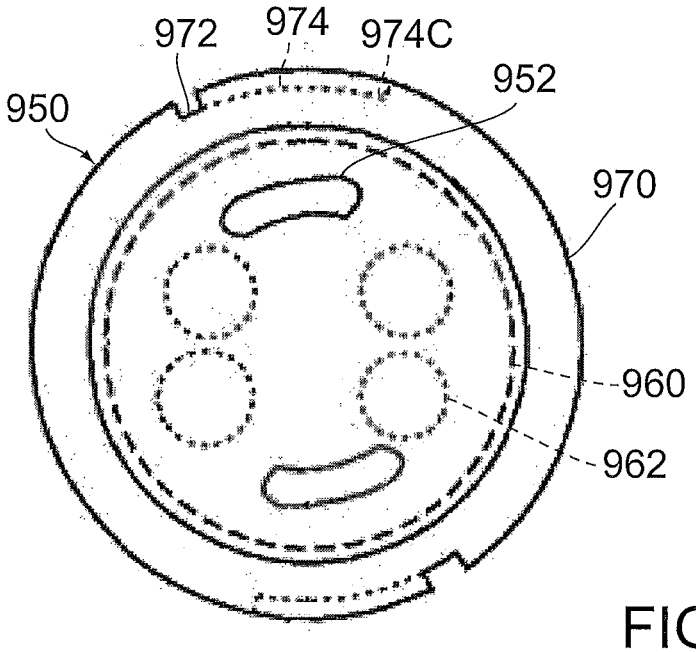
FIG.28 PRIOR ART
FIG. 28 is a top view showing a current supply housing 950 of Patent Document 1.
Figure 29:
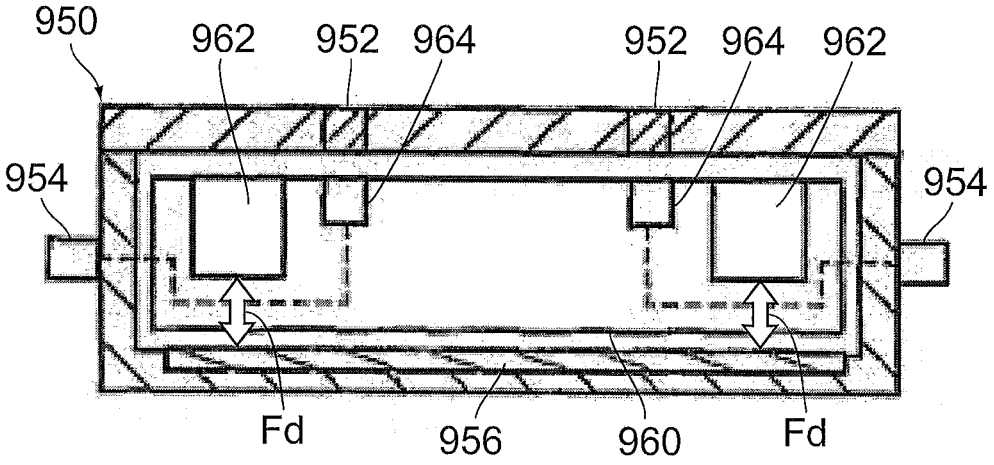
FIG.29 PRIOR ART
FIG. 29 is a cross-sectional view showing the current supply housing 950 of Patent Document 1.

Referring to FIG. 21, a connector pair 10D according to a forth embodiment of the present invention comprises a connector 20D and a mating connector 50D. Referring to FIGS. 21, 25 and 26, a movement of the connector 20D from an unmated position (the position shown in FIG. 21) to a first position (the position shown in FIG. 25) along the Z-direction causes the connector 20D to be mated with the mating connector 50D, and another movement of the connector 20D from the first position to a second position (the position shown in FIG. 26) along a circumference direction (C-direction: second direction) completes a connection between the connector 20D and the mating connector 50D.

Figure 22:
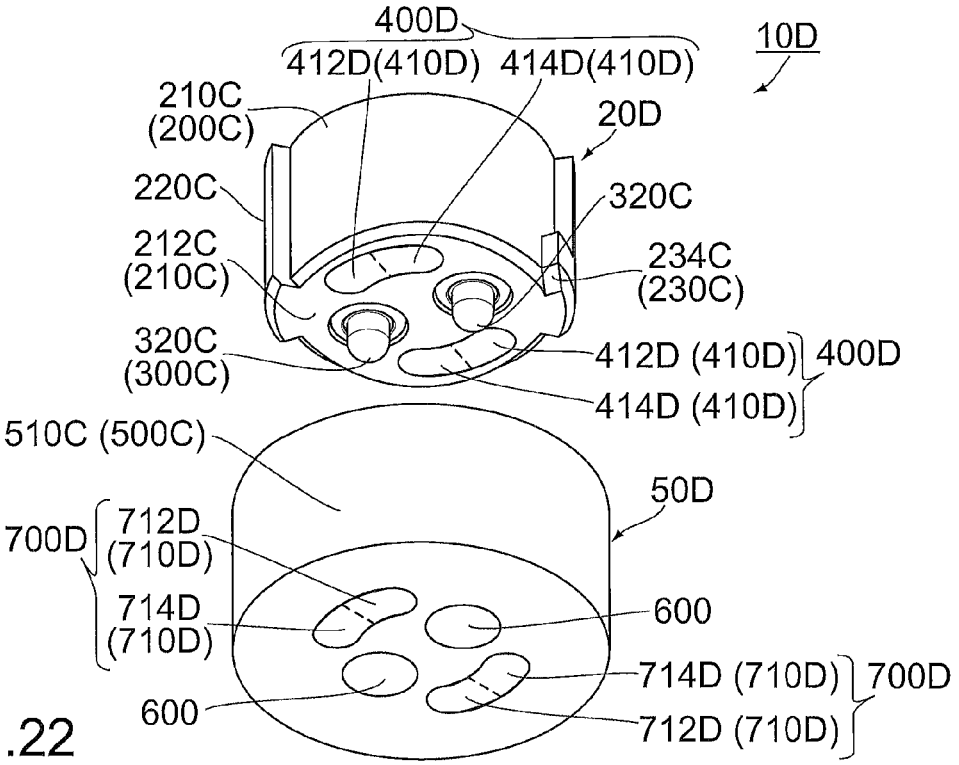
FIG. 22 is another perspective view showing the connector pair of FIG. 21.
Figure 23:
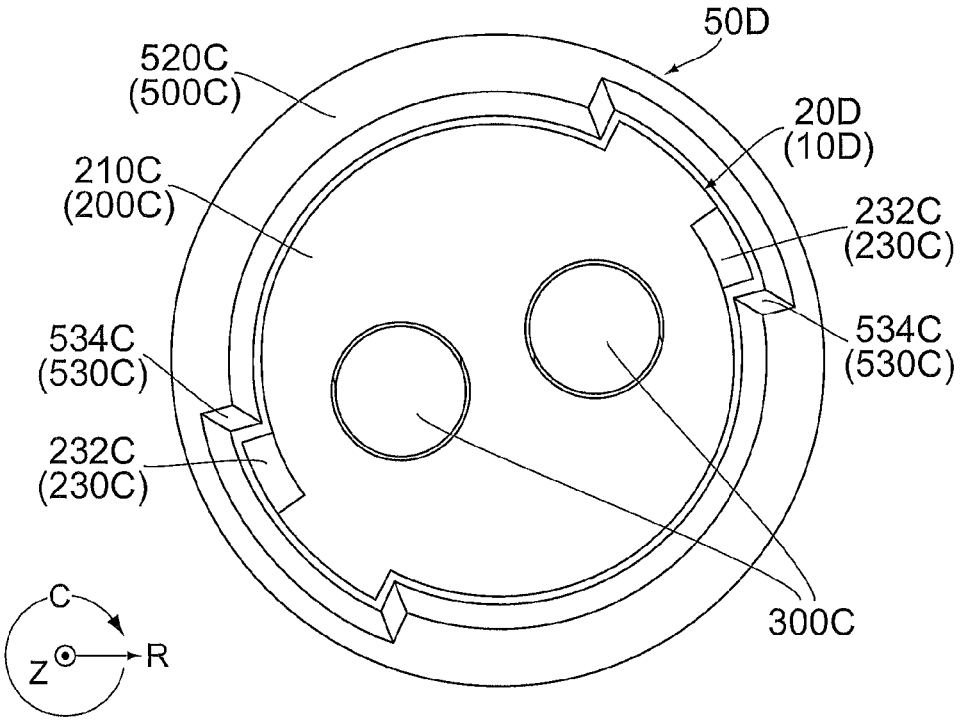
FIG. 23 is a top view showing the connector pair of FIG. 21, wherein the connector is located at a first position.

Referring to FIGS. 21 to 23 as well as FIGS. 17 and 18, the connector 20D according to the present embodiment has a structure same as that of the connector 20C and works similar to the connector 20C except that the connector 20D comprises two magnets 410D different from the magnets 410C. The mating connector 50D according to the present embodiment has a structure same as that of the mating connector 50C and works similar to the mating connector 50C except that the mating connector 50D comprises two mating magnets (magnets) 710D different from the magnets 710C.

Figure 24:
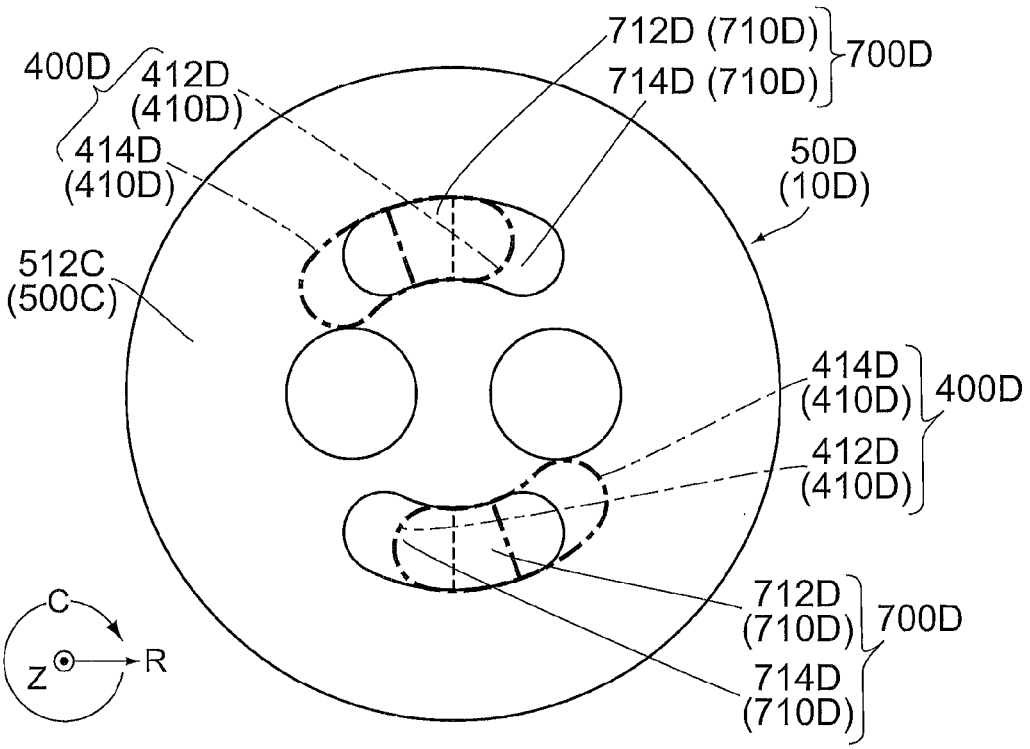
FIG. 24 is a plan view showing a mating face portion of the mating connector of FIG. 23 from above, wherein a magnetic portion of the connector is illustrated by chain dotted line.

Referring to FIGS. 22 and 24, each of the magnets 410D according to the present embodiment is a permanent magnet having an arc-like shape. Each of the magnets 410D has a north pole portion 412D and a south pole portion 414D. In the present embodiment, the north pole portion 412D is a part of the magnet 410D having the corresponding south pole portion 414D.

The connector 20D according to the present embodiment comprises a magnetic portion 400D consisting of the two north pole portions 412D each of which is a magnetic north pole and the two south pole portions 414D each of which is a magnetic south pole. The face portion 212C holds the north pole portions 412D and the south pole portions 414D alternately arranged in the circumference direction. In detail, the north pole portions 412D are arranged in rotational symmetry with each other around the central axis of the holding portion 210C. Similarly, the south pole portions 414D are arranged in rotational symmetry with each other around the central axis of the holding portion 210C.

Referring to FIGS. 21, 22 and 24, each of the magnets 710D according to the present embodiment is a magnet same as the magnet 410D. Each of the magnets 710D has a mating north pole portion 712D and a mating south pole portion 714D. In the present embodiment, the mating north pole portion 712D is a part of the magnet 710D having the corresponding mating south pole portion 714D.

The mating connector 50D according to the present embodiment comprises a mating magnetic portion 700D consisting of the two mating north pole portions 712D each of which is a magnetic north pole and the two mating south pole portions 714D each of which is a magnetic south pole. The mating face portion 512C holds the mating north pole portions 712D and the mating south pole portions 714D alternately arranged in the circumference direction. In detail, the mating north pole portions 712D are arranged in rotational symmetry with each other around the central axis of the holding portion 510C. Similarly, the mating south pole portions 714D are arranged in rotational symmetry with each other around the central axis of the holding portion 510C.

As can be seen from FIG. 24, the two magnets 410D positionally correspond to the two magnets 710D, respectively. When the connector 20D is located at the first position, each of the south pole portions 414D receives an attractive force along the positive C-direction (clockwise direction in FIG. 24) from the corresponding mating north pole portion 712D. Moreover, when the connector 20D is located at the first position, each of the north pole portions 412D receives an attractive force along the positive C-direction from the corresponding mating south pole portion 714D while receiving a repulsive force along the positive C-direction from the corresponding mating north pole portion 712D.

As can be seen from the above explanation, when the connector 20D is located at the first position, the magnetic portion 400D receives a force, which urges the connector 20D to be moved toward the second position, from the mating magnetic portion 700D. According to the present embodiment, the connector pair 10D is provided with a plurality of pairs (magnetic pairs) each of which consists of the north pole portion 412D and the south pole portion 414D, and a plurality of pairs (mating magnetic pairs) each of which consists of the mating north pole portion 712D and the mating south pole portion 714D. The magnetic pairs are arranged in the circumference direction so as to correspond to the respective mating magnetic pairs arranged in the circumference direction. This arrangement allows the connector 20D to be moved more accurately along the circumference direction. According to the present embodiment, a structure, in which the two magnets 410D and the two magnets 710D are simply arranged, can exert a magnet force to connect the connector 20D with the mating connector 50D.

Referring to FIG. 24, each of the north pole portions 412D, the south pole portions 414D, the mating north pole portions 712D and the mating south pole portions 714D has its predetermined end which is located rotationally forward thereof along the positive C-direction, or along a clockwise direction in FIG. 24. As can be seen from FIGS. 24 to 26, when the connector 20D is moved from the first position to the second position, each of the north pole portions 412D and the south pole portions 414D of the magnetic portion 400D is moved forward (clockwise in FIG. 24) along the circumference direction (C-direction). During this movement, an overlapped region between the north pole portion 412D and the corresponding mating south pole portion 714D in the perpendicular plane gradually increases in its size, and another overlapped region between the south pole portion 414D and the corresponding mating north pole portion 712D in the perpendicular plane gradually increases in its size. In detail, as the connector 20D approaches the second position, the predetermined end of the north pole portion 412D approaches the predetermined end of the corresponding mating south pole portion 714D, and the predetermined end of the south pole portion 414D approaches the predetermined end of the corresponding mating north pole portion 712D. In the meantime, the north pole portion 412D is moved to be away from the corresponding mating north pole portion 712D as a whole. When the connector 20D is located at the second position, the magnetic portion 400D receives a force, which binds the connector 20D at the second position, from the mating magnetic portion 700D.

The present invention can be further variously applicable in addition to the aforementioned various embodiments and modifications. For example, the number of the magnets and/or the number of the mating magnets may be equal to or more than three. Moreover, the magnet and the mating magnet do not need to be exposed outward, provided that a sufficient magnetic force can be applied to each other. For example, each of the magnet and the mating magnet may be wholly buried within its holding portion. Moreover, although the magnet and the mating magnet in each of the aforementioned embodiments are fixed to the connector and the mating connector, respectively, so as not to be moved relative to the connector and the mating connector, respectively, each of the magnet and the mating magnet may be supported by its holding portion to be movable in the Z-direction. Moreover, each of the lower end of the face portion and the upper end of the mating face portion does not need to be a plane, provided that the movement of the connector is allowed. Moreover, not the contact portion of the contact but the contact portion of the mating contact may be supported to be movable in the Z-direction by a spring portion.

The present application is based on a Japanese patent application of JP2014-256345 filed before the Japan Patent Office on Dec. 18, 2014, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector pair comprising a connector and a mating connector, wherein:

a movement of the connector to a first position along a first direction causes the connector to be mated with the mating connector;

another movement of the connector from the first position to a second position along a second direction perpendicular to the first direction completes a connection between the connector and the mating connector;

the connector comprises a face portion and a magnetic portion;

the face portion holds the magnetic portion which includes a north pole portion and a south pole portion arranged in the second direction;

the mating connector comprises a mating face portion and a mating magnetic portion;

the mating face portion holds the mating magnetic portion which includes a mating north pole portion and a mating south pole portion arranged in the second direction;

the face portion and the mating face portion face each other in the first direction not only when the connector is located at the first position but also when the connector is located at the second position;

when the connector is located at the first position, the magnetic portion receives a force, which urges the connector to be moved toward the second position, from the mating magnetic portion;

when the connector is located at the second position, the magnetic portion receives a force, which binds the connector at the second position, from the mating magnetic portion;

the connector comprises a stopped portion;

the mating connector comprises a stopping portion;

when the connector is located at the second position, the stopping portion faces the stopped portion in the first direction to prevent a removal of the connector from the mating connector only along the first direction;

when the connector is forced to be moved forward from the second position along the second direction, the connector is brought into abutment with the mating connector so that the mating connector stops the connector;

the second direction is a linearly extending direction; and the movement of the connector from the first position to the second position is a linear movement along the second direction.

2. The connector pair as recited in claim 1, wherein:

when the connector is moved from the first position to the second position, each of the north pole portion and the south pole portion is moved forward along the second direction;

each of the north pole portion, the south pole portion, the mating north pole portion and the mating south pole portion has a predetermined end which is located forward thereof in the second direction;

when the connector is located at the first position, the predetermined end of the north pole portion is placed rearward of the predetermined end of the mating south pole portion in the second direction, and the predetermined end of the south pole portion is placed rearward of the predetermined end of the mating north pole portion in the second direction; and as the connector approaches the second position, the predetermined end of the north pole portion approaches the predetermined end of the mating south pole portion, and the predetermined end of the south pole portion approaches the predetermined end of the mating north pole portion.

3. The connector pair as recited in claim 2, wherein:

when the connector is located at the first position, one of the north pole portion and the south pole portion receives an attractive force from one of the mating north pole portion and the mating south pole portion and receives a repulsive force from a remaining one of the mating north pole portion and the mating south pole portion; and each of the attractive force and the repulsive force urges the connector to be moved toward the second position.

4. The connector pair as recited in claim 1, wherein the north pole portion is a part of a magnet having the south pole portion.

5. The connector pair as recited in claim 1, wherein the north pole portion is a part of a magnet which is separated from another magnet having the south pole portion.

6. The connector pair as recited in claim 1, wherein:

the connector comprises a plurality of pairs each of which includes the north pole portion and the south pole portion; and the mating connector comprises a plurality of pairs each of which includes the mating north pole portion and the mating south pole portion.

7. The connector pair as recited in claim 1, wherein when the connector is located at the second position, at least one of the stopped portion and the stopping portion extends along an oblique direction oblique to both the first direction and the second direction to allow a removal of the connector from the mating connector along the oblique direction.

8. The connector pair as recited in claim 1, wherein:

the connector pair comprises a plurality of stopping pairs each of which includes the stopped portion and the stopping portion; and at least two of the stopping pairs are apart from each other in the second direction.

9. The connector pair as recited in claim 1, wherein:

the connector comprises a contact;

the contact has a spring portion and a contact portion; and the contact portion is resiliently supported by the spring portion to be movable in the first direction.

* * * * *